US008626055B2

(12) United States Patent
Hwang et al.

(10) Patent No.: US 8,626,055 B2
(45) Date of Patent: Jan. 7, 2014

(54) METHOD FOR DELIVERING SERVICE GUIDE SOURCE FOR GENERATION OF SERVICE GUIDE IN A MOBILE BROADCAST SYSTEM, AND METHOD AND SYSTEM FOR DELIVERING NOTIFICATION EVENT/NOTIFICATION MESSAGE

(75) Inventors: Sung-Oh Hwang, Yongin-si (KR); Jae-Kwon Oh, Seoul (KR); Kook-Heui Lee, Yongin-si (KR); Byung-Rae Lee, Seoul (KR); Jae-Yong Lee, Seoul (KR); Bo-Sun Jung, Seongnam-si (KR); Jong-Hyo Lee, Pyeongtack-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1172 days.

(21) Appl. No.: 11/593,645

(22) Filed: Nov. 7, 2006

(65) Prior Publication Data

US 2007/0124359 A1 May 31, 2007

(30) Foreign Application Priority Data

Nov. 7, 2005 (KR) ..... 10-2005-0106216
Mar. 3, 2006 (KR) ..... 10-2006-0020678

(51) Int. Cl.
*H04H 20/71* (2008.01)

(52) U.S. Cl.
USPC ..... 455/3.01

(58) Field of Classification Search
USPC ..... 455/466, 412, 418, 419, 517; 348/730, 348/E05.127; 380/286, 44; 370/480, 486, 370/468, 489, 485, 487, 490, 449, 450, 451, 370/346, 349, 467, 312, 535, 389, 392, 410, 370/310; 725/105, 48, 49; 709/200, 203, 709/219, 236; 340/7.1–7.63, 7.29
See application file for complete search history.

(56) References Cited

U.S. PATENT DOCUMENTS 596,663 A * 1/1898 Gleason ..... 298/7
5,953,348 A * 9/1999 Barn ..... 370/480

(Continued)

FOREIGN PATENT DOCUMENTS

EP 1499086 1/2005
JP 10336175 12/1998

(Continued)

OTHER PUBLICATIONS

OMA-AD-BCAST-V1_0-20050505-D.pdf.*

(Continued)

*Primary Examiner* — Charles Appiah
*Assistant Examiner* — Alexander Yi
(74) *Attorney, Agent, or Firm* — Roylance, Abrams, Berdo & Goodman, L.L.P.

(57) ABSTRACT

A mobile broadcast system for delivering a notification event for generation of a notification message for information provisioning to a subscriber receiving a broadcast service is provided. The mobile broadcast system includes a first apparatus for managing subscriber information of the broadcast service, handling generation of at least one notification message according to at least one notification event, and generating a response message indicating generation end of the notification message; and a second apparatus for sending a notification event message for requesting generation of the notification message to the first apparatus according to the at least one notification event, receiving the response message in response thereto, and then handling delivery of the notification message over a broadcast channel or an interaction channel.

30 Claims, 10 Drawing Sheets

(56) References Cited

U.S. PATENT DOCUMENTS

| | | | | |
|---|---|---|---|---|
| 6,167,448 | A | 12/2000 | Hemphill et al. | |
| 7,035,914 | B1 * | 4/2006 | Payne et al. | 709/219 |
| 7,461,150 | B1 * | 12/2008 | Boulia | 709/227 |
| 2004/0180675 | A1 | 9/2004 | Choi et al. | |
| 2005/0043020 | A1 | 2/2005 | Lipsanen et al. | |

FOREIGN PATENT DOCUMENTS

| | | | |
|---|---|---|---|
| JP | 2003-023617 | A | 1/2003 |
| JP | 2003224584 | | 8/2003 |
| JP | 2004-135260 | A | 4/2004 |
| JP | 2004-280791 | A | 10/2004 |
| JP | 2005/524333 | A | 8/2005 |
| JP | 2005-236988 | | 9/2005 |
| JP | 2006-522569 | A | 9/2006 |
| RU | 2262811 | | 10/2005 |
| WO | 0201879 | A2 | 1/2002 |
| WO | WO 2004/042972 | A2 | 5/2004 |
| WO | WO 2004/068358 | A1 | 8/2004 |
| WO | WO 2004/091156 | A2 | 10/2004 |

OTHER PUBLICATIONS

OMA-TS_BCAST_ServiceGuide-V1_0_0-20051026-D.pdf.*

"Mobile Broadcast Services Architecture", Open Mobile Alliance OMA-AD- BCAST-V1_0-20050330-D, Draft Version 1.0—15 30 2005, 2005 Open Mobile Alliance Ltd., pp. 1-44.

OMA Open Mobile Alliance, "Proposal for Notification Flows for BCAST AD", Doc# OMA-BCAST-2005-0365-IC-proposal_for_Notification_flows, Input Contribution, 2004 Open Mobile Alliance Ltd., pp. 1-7.

Japanese Office Action, dated Dec. 6, 2 pages, including English translation of JP Office Action, 3 pages.

XP 002439100, Mobile Broadcast Services Architecture Draft Version 1.0, Open Mobile Alliance OMA-AD-BCAST-V1_0-20050420-D, © 2005 Open Mobile Alliance Ltd., 88 pages.

European Search Report, Application No. 06023160.2, Dated Sep. 24, 2012, Applicant: Samsung Electronics Co., Ltd., 8 pages.

* cited by examiner

METHOD FOR DELIVERING SERVICE GUIDE SOURCE FOR GENERATION OF SERVICE GUIDE IN A MOBILE BROADCAST SYSTEM, AND METHOD AND SYSTEM FOR DELIVERING NOTIFICATION EVENT/NOTIFICATION MESSAGE

CROSS-REFERENCE TO RELATED APPLICATIONS

This application claims the benefit under 35 U.S.C. §119 (a) of a Korean Patent Application filed in the Korean Intellectual Property Office on Nov. 7, 2005 and assigned Serial No. 2005-106216, and Korean Patent Application filed in the Korean Intellectual Property Office on Mar. 3, 2006 and assigned Serial No. 2006-20678, the entire contents of both of which are hereby incorporated by reference.

BACKGROUND OF THE INVENTION

1. Field of the Invention

The present invention relates generally to an information providing method and a message delivery method in a mobile broadcast system. In particular, the present invention relates to a method and system for delivering notification event/notification message for providing various guide information to a service guide source for service guide generation at a mobile terminal.

2. Description of the Related Art

The mobile communication market continuously requires creation of new services through recombination or integration of the existing technologies. Current development of communication and broadcast technologies has allowed conventional broadcasting systems and mobile communication systems to provide broadcast services through portable terminals (or mobile terminals), such as mobile phones and personal digital assistants (PDAs). Due to latent and actual market needs and increasing user demand for multimedia services, service providers' intended strategies for providing new services such as broadcast service in addition to the existing voice service, and the identified interests of Information Technology (IT) companies which are bolstering their mobile communication businesses to meet the user's demands, convergence of mobile communication service and Internet Protocol (IP) has become a priority in the development of next generation mobile communication technologies.

Open Mobile Alliance (OMA), a group for studying the standard for interworking between individual mobile solutions, serves to define various application standards for mobile games and Internet services. Of the OMA working groups, Open Mobile Alliance Browser and Content Mobile Broadcast Sub Working Group (OMA BAC BCAST) is researching on the technology for providing broadcast services using mobile terminals. A brief description will now be made of the Mobile Broadcast (BCAST) system which is under discussion in OMA.

In the mobile broadcast system, a mobile terminal desiring to receive a broadcast service should receive so-called service guide information containing description information for the service itself, charging information for the service, and information on a receiving method for the service. The mobile terminal receives the corresponding service using the service guide information. Although a description of the conventional broadcast service method will be described with reference to the BCAST system as an example of a mobile broadcast system using a service guide, the present invention is not limited to the BCAST system.

FIG. 1 illustrates an exemplary architecture of a general mobile broadcast system that delivers a service guide to a mobile terminal. Table 1 and Table 2 below show interfaces between constituent elements (e.g., logical entities) of FIG. 1.

TABLE 1

| Name | Description |
|---|---|
| SG1 (103) | Server-to-server communications for delivering content attributes such as description information, location information, target terminal capabilities, target user profile, and so on, either in the form of BCAST service guide fragments or in a proprietary format. |
| SG2 (106) | Server-to-server communications for delivering BCAST service attributes such as service/content description information, scheduling information, location information, target terminal capabilities, target user profile, and so on, in the form of BCAST service guide fragments. |
| SG-B1 (116) | Server-to-server communications for either delivering BDS specific attributes from Broadcast Distribution System (BDS) to BCAST Service Guide Adaptation function, to assist Service Guide adaptation to specific BDS, or to deliver BCAST Service Guide attributes to BDS for BDS specific adaptation and distribution. |
| SG4 (112) | Server-to-server communications for delivering provisioning information, purchase information, subscription information, promotional information, and so on, in the form of BCAST service guide fragments. |
| SG5 (117) | Delivery of BCAST Service Guide through Broadcast Channel, over IP. |
| SG6 (118) | Delivery of BCAST Service Guide through Interaction Channel. Interactive access to retrieve Service Guide or additional information related to Service Guide, for example, by HTTP, SMS, or MMS. |

TABLE 2

| Name | Description |
|---|---|
| X-1 (124) | Reference Point between BDS Service Distribution and BDS. |
| X-2 (125) | Reference Point between BDS Service Distribution and Interaction Network. |
| X-3 (126) | Reference Point between BDS and Terminal. |
| X-4 (127) | Reference Point between BDS Service Distribution and Terminal over Broadcast Channel. |
| X-5 (128) | Reference Point between BDS Service Distribution and Terminal over Interaction Channel. |
| X-6 (129) | Reference Point between Interaction Network and Terminal. |

Referring to FIG. 1, the Content Creation (CC) block 101 represents a content creator or content provider that is a provider of Broadcast service (BCAST), and the BCAST service can include the conventional audio/video broadcast service, music/data file download service, and so on. The Content Creation 101, including a Service Guide Content Creation Source (SGCCS) 102, delivers content information necessary for creation of a service guide for the BCAST service, capability information of mobile terminals, user profile, and content time information to a Service Guide Application Source (SGAS) 105 of a BCAST Service Application (BSA) block 104 through the SG1 interface 103 of Table 1.

The BCAST Service Application block 104 processes data of the BCAST service provided from the Content Creation block 101 in the form appropriate for a BCAST network, making BCAST service data. In addition, the BCAST service Application block 104 generates standardized metadata necessary for mobile broadcast guide. The SGAS 105 delivers various sources necessary for generation of a service guide, such as detailed service/content information, scheduling information, and location information, including the information provided from the SGCCS 102, to a Service Guide Generation (SG-G) 109 in a BCAST Service Distribution/Adaptation (BSD/A) block 108 via the SG2 interface 106.

The BCAST Service Distribution/Adaptation block 108 has a function of setting up a bearer over which it will deliver the BCAST service data provided from the BCAST Service Application block 104, a function of determining transmission scheduling of the BCAST service, and a function of creating mobile broadcast guide information. The BCAST Service Distribution/Adaptation block 108 is connected to a Broadcast Distribution System (BDS) 122, which is a network for transmitting BCAST service data, and an Interaction Network 123 supporting interactive communication.

The service guide generated by the SG-G 109 is delivered to a Terminal 119 via an SG Distribution (SG-D) 110 and the SG5 interface 117. If the service guide is delivered via the BDS 122 or the Interaction Network 123 supporting interactive communication, or if there is a need for matching with the corresponding system or network, the service guide generated by the SG-G 109 is matched in an SG Adaptation (SG-A) 111 and then delivered to the SG-D 110, or is delivered to a BDS Service Distribution block 121 via the SG-B1 interface 116.

A BCAST Subscription Management block 113 manages subscription information and service provisioning information for receipt of BCAST service, and device information for a terminal receiving BCAST service. A Service Guide Subscription Source (SGSS) 114 in the BCAST Subscription Management block 113 delivers sources related to service guide generation, subscription and provisioning, and such sources as purchase information and publicity-related information to the SG-G 109 that generates the service guide, via the SG4 interface 112.

The BDS Service Distribution block 121 serves to distribute all received BCAST services through a broadcast channel or an interaction channel, and is an entity that can either exist or not exist according to type of the BDS 122. The BDS 122 is a network that transmits BCAST service, and can be a broadcast network such as Digital Video Broadcasting-Handheld (DVB-H), 3GPP-based Multimedia Broadcast and Multicast Services (MBMS), 3GPP2-based Broadcast and Multicast Services (BCMCS). The Interaction Network 123 transmits BCAST service on a point-to-point basis, or interactively exchanges control information and additional information related to reception of the BCAST service, and can be, for example, the existing cellular network.

The Terminal 119 is a terminal capable of receiving the BCAST service via an Ai interface 130, and can be connected to the cellular network according to terminal capability. The Terminal 119, including a Service Guide Client (SG-C) 120, receives the service guide delivered via the SG5 interface 117 or receives the notification message delivered via the SG6 interface 118, thereby performing an appropriate operation for receipt of the BCAST service.

Table 3 to Table 5 below give a brief description of the key elements (e.g., logical entities) of FIG. 1 defined in the BCAST service standard.

TABLE 3

| Name | Description |
|---|---|
| Content Creation (101) | Service Guide Content Creation Source (SGCCS) may provide contents and attributes such as content description information, target terminal capabilities, target user profile, content timing information, and so on, and sends them over SG1 in the form of standardized BCAST Service Guide fragments, or in a proprietary format. |
| BCAST Service Application (104) | Service Guide Application Source (SGAS) provides service/content description information, scheduling information, location information, target terminal capabilities, target user profile, and so on, and sends them over SG2 in the form of standardized BCAST Service Guide fragments. |
| BCAST Subscription Management (113) | Service Guide Subscription Source (SGSS) provides provisioning information, purchase information, subscription information, promotional information, and so on, and sends them over SG4 in the form of Service Guide fragments. |

TABLE 4

| Name | Description |
|---|---|
| Service Guide Generation (SG-G) (109) | SG-G in the network is responsible for receiving Service Guide fragments from various sources such as SGCCS, SGAS, SGSS over SG-2 and SG-4 interfaces. SG-G assembles the fragments such as services and content access information, according to a standardized schema, and generates Service Guide which is sent to Service Guide Distribution (SG-D) for transmission. Before transmission, it is optionally adapted in the Service Guide Adaptation Function (SG-A) 111 to suit a specific BDS. |
| Service Guide Client Function (SG-C) (120) | SG-C in the terminal is responsible for receiving the Service Guide information from the underlying BDS, and making the Service Guide available to the mobile terminal. The SG-C obtains specific Service Guide information. It may filter it to match the terminal specified criteria (for example, location, user profile, terminal capabilities), or it simply obtains all available Service Guide information. Commonly, the user may view the Service Guide information in a menu, list or tabular format. SG-C may send a request to the network through SG-6 to obtain specific Service Guide information, or the whole Service Guide. |

TABLE 5

| Name | Description |
|---|---|
| Service Guide Distribution (SG-D) (110) | SG-D generates an IP flow to transmit Service Guide over the SG5 interface and the broadcast channel to the SG-C. Before transmission, the SG-G may send Service Guide to Service Guide Adaptation (SG-A) to adapt the Service Guide to suit specific BDS, according to the BDS attributes sent by BDS Service Distribution over SG-B1. The adaptation might result in modification of Service Guide. Note that, for adaptation purpose, the SG-A may also send the BCAST Service Guide attributes or BCAST Service Guide fragments over SG-B1 to BDS Service Distribution for adaptation, this adaptation within BDS Service Distribution is out of the scope of BCAST. SG-D |

TABLE 5-continued

| Name | Description |
|---|---|
| | may also receive a request for Service Guide information, and send the requested Service Guide information to the terminal directly through the interaction channel. SG-D also may filter Service Guide information from SG-G based on End User's pre-specified profile. And SG-D may also send the Service Guide to the BDS, which modifies the Service Guide (e.g., by adding BDS specific information), and further distributes the Service Guide to the SG-C in a BDS specific manner. |

FIG. 2 is a diagram illustrating notification architecture defined in BCAST service to deliver a notification message in the mobile broadcast system of FIG. 1.

Referring to FIG. 2, a Content Creation (CC) block 201 is a provider of BCAST service, and the BCAST service can include the conventional audio/video broadcast service, music/data file download service, and so on. When there is a problem in providing BCAST service or there is a change in the BCAST service, the Content Creation block 201 notifies the change to a Notification Event Function (NTE) 202-1 located in a BCAST Service Application 202.

The BCAST Service Application 202 processes data of the BCAST service provided from the Content Creation block 201 in the form appropriate for a BCAST network, making BCAST service data, and generates standardized metadata necessary for mobile broadcast guide. In addition, the BCAST Service Application 202 notifies the change in the BCAST service provided from the Content Creation block 201 to a Notification Generation function (NTG) 204-1 located in a BCAST Subscription Management (BSM) 204.

A BCAST Service Distribution/Adaptation 203 is responsible for setting up a bearer over which it will deliver the BCAST service data provided from the BCAST Service Application 202, determining transmission scheduling of the BCAST service, and generating mobile broadcast guide, and is connected to a Broadcast Distribution system (BDS) 206 capable of providing the BCAST service, and an Interaction Network 207 supporting interactive communication. In addition, the BCAST Service Distribution/Adaptation 203, including a Notification Distribution Adaptation function (NTDA) 203-1, receives the notification message from the BCAST Subscription Management 204 and delivers the notification message to one or a plurality of users via the BDS 206 or the Interaction Network 207.

The BCAST Subscription Management 204 manages subscription information for receipt of the BCAST service, service provisioning information, and device information for a device receiving the BCAST service. In particular, the BCAST Subscription Management 204, including the Notification Generation function 204-1, generates a notification message by receiving the information on a notification event from the Content Creation block 201 and the BDS 206, or generates a notification message for the BCAST service event.

A BDS Service Distribution 205 serves to distribute all received BCAST services through a broadcast channel or an interaction channel, and is an entity that can either exist or not exist according to type of the BDS 206.

The BDS 206 is a network that delivers BCAST service, and can be, for example, DVB-H, 3GPP-based MBMS, and 3GPP2-based BCMCS. In addition, when there is a change in delivering a particular BCAST service, the BDS 206 notifies the change to the BCAST Service Distribution/Adaptation 203 via an X-1 interface 231, or via an NT-B1 interface 224 if the BDS Service Distribution 205 exists.

The Interaction Network 207 delivers BCAST data on a point-to-point basis, or interactively exchanges control information and additional information related to reception of the BCAST service, and can be, for example, the existing cellular network.

A Terminal 208 is a terminal capable of receiving the BCAST service, and can be connected to the cellular network according to terminal capability. It is assumed herein that the Terminal 208 is a terminal capable of accessing the cellular network. The Terminal 208 performs an appropriate operation by receiving a notification message delivered via an NT-5 interface 225 by a Notification Client function (NTC) 208-1, or performs an appropriate operation by receiving a notification message delivered via an NT-6 interface 226.

A description will now be made of backend interfaces between the logical entities of FIG. 2.

An NT-1 interface 221, an interface between the Notification Event Function 202-1 located in the BCAST Service Application 202 and the Content Creation block 201, is used for delivering a notification event occurring in the Content Creation block 201 to the Notification Event Function 202-1.

An NT-3 interface 222, an interface between the Notification. Event Function 202-1 located in the BCAST Service Application block 202 and the Notification Generation function 204-1 in the BCAST Subscription Management 204, delivers information necessary for generation of a notification event or a notification message so that the Notification Generation function 204-1 can generate the notification message.

An NT-4 interface 223, an interface between the Notification Generation function 204-1 located in the BCAST Subscription Management 204 and the Notification Distribution Adaptation function 203-1 in the BCAST Service Distribution/Adaptation 203, is used for delivering the notification message generated in the Notification Generation function 204-1 to the Notification Distribution Adaptation function 203-1 so that it is delivered via the BDS 206 or the Interaction Network 207, or delivering the notification event occurred in the BDS 206 from the Notification Distribution Adaptation function 203-1 to the Notification Generation function 204-1.

An NT-5 interface 225 is an interface used when a notification message delivered from the Notification Distribution Adaptation function 203-1 in the BCAST Service Distribution/Adaptation 203 is directly delivered to the Terminal 208 through the broadcast channel. The NT-5 interface 225 is used for delivering a notification message to one or a plurality of terminals.

An NT-6 interface 226 is an interface used when a notification message delivered from the Notification Distribution Adaptation function 203-1 in the BCAST Service Distribution/Adaptation 203 is directly delivered to the Terminal 208 through the dedicated channel with the Terminal 208 via the Interaction Network 207 or through the broadcast channel provided in the Interaction Network 207. The NT6 interface 226 is used for delivering the notification message to one or a plurality of terminals.

An NT-B1 interface 224, an interface between the BCAST Service Distribution/Adaptation 203 and the BDS Service Distribution 205, is used for establishing a transmission path to be used in the BDS 206 by the BCAST Service Distribution/Adaptation 203, or a reception path of the notification event occurred in the BDS 206.

An X-1 interface 231 is an interface used for establishing a transmission path to be used in the BDS 206 by the BCAST Service Distribution/Adaptation 203 or a reception path of the notification event occurred in the BDS 206 when the BDS Service Distribution 205 does not exist. When the BDS Service Distribution 205 exists, the X-1 interface 231 is used as an interface between the BDS 206 and the BDS Service Distribution 205, for delivering the notification event occurred in the BDS 206.

An X-2 interface 232 is an interface used for establishing a transmission path to be used in the Interaction Network 207 by the BCAST Service Distribution/Adaptation 203 when the BDS Service Distribution 205 does not exist. When the BDS Service Distribution 205 exists, the X-2 interface 232 is used as an interface between the BDS 206 and the Interaction Network 207, for setting up a bearer over which the notification message will be transmitted in the Interaction Network 207.

An X-3 interface 233, an interface between the BDS 206 and the Terminal 208, is used for the BCAST service or all messages transmitted through the broadcast channel.

An X-4 interface 234 is a broadcast channel interface between the BDS Service Distribution 205 and the Terminal 208.

An X-5 interface 235 is an interaction channel interface between the BDS Service Distribution 205 and the Terminal 208.

An X-6 interface 236 is an interaction channel interface with which the Interaction Network 207 can transmit BCAST service-related control information.

The Notification Event Function 202-1 delivers the information necessary for generating a notification message to the Notification Generation function 204-1, and upon recognizing occurrence of a notification-required event (i.e. notification event), delivers information on the notification event to the Notification Generation function 204-1. The Notification Generation function 204-1 generates a notification message by receiving the notification event and the information necessary for generation of the notification message from the Notification Event Function 202-1, or generates a notification message using the notification event of the BDS 206 received through the Notification Distribution Adaptation function 203-1, and delivers the generated notification message to the Notification Distribution Adaptation function 203-1. The notification message can be generated (i) when there is a need to notify again start of the service, (ii) when there is a need to deliver a new mobile broadcast guide upon receipt of a notification indicating a change in the service information from the Content Creation block 201, and (iii) when a particular event occurs in the BDS 206.

The Notification Distribution Adaptation function 203-1 serves to deliver a notification message via the NT5 225 or the NT6 226, and upon receiving from the BDS 206 a notification indicating a change in a particular mobile broadcast service, for example, indicating adjustment of a data rate based on the wireless network environment or impossibility of the service, serves to deliver the corresponding notification event to the Notification Generation function 204-1 via the NT4 223.

FIG. 3 is a signaling diagram illustrating a message flow between logical entities for providing a service guide in a general mobile broadcast system.

Herein, reference numeral 301 indicates the SGCCS 102 in the Content Creator block 101, reference numeral 302 indicates the SGAS 105 in the BCAST Service Application block 104, reference numeral 303 indicates the SGSS 114 in the BCAST Subscription Management block 113, and reference numeral 304 indicates the SG-G/D/A 109, 110 and 111 in the BCAST Service Distribution/Adaptation block 108.

Referring to FIG. 3, in step 311, the SGCCS 301 delivers content information and attributes associated with the BCAST service to the SGAS 302. In step 312, the SGAS 302 delivers the broadcast content/service information and attributes to the SG-G/D/A 304 according to a BCAST format using the attributes provided from the SGCCS 301. In step 313, the SG-G/D/A 304 sends a request for provisioning-related information to the SGSS 303. In step 314, the SGSS 303 provides the requested provisioning-related information to the SG-G/D/A 304. In step 315, the SG-G/D/A 304 generates a service guide (SG).

FIG. 4 is a signaling diagram illustrating a message flow between logical entities for providing a notification message in a general mobile broadcast system.

Herein, reference numeral 401 indicates the Notification Event Function (NTE) 202-1 in the BCAST Service Application block 202, reference numeral 402 indicates the Notification Generation function (NTG) 204-1 in the BCAST Subscription Management block 204, and reference numeral 403 indicates the Notification Distribution Adaptation function (NTDA) 203-1 in the BCAST Service Distribution/Adaptation block 203.

Referring to FIG. 4, a notification event is generated in the NTE 401 or the NTDA 403 and then delivered to the NTG 402, or is generated in the BCAST Subscription Management block 204 or the BDS 206. That is, if a notification event occurs in the Content Creation block 201 or the BSA 202, the NTE 401 delivers in step 411 an Event notice to the NTG 402 in the BSM 204 through the NT3 interface 222. If the notification event has occurred in the BCAST Service Distribution/Adaptation 203 or the BDS 206, the notification event information is delivered from the NTDA 403 to the NTG 402 via the NT4 interface 223 in step 412. The notification event can also be spontaneously generated in the BSM 204 and then delivered to the NTDA 403 via the NTG 402. In step 413, the NTG 402 spontaneously generates the notification event or receives the notification event via the NT3 222 or the NT4 223. In step 414, the NTG 402 generates a notification message. Thereafter, the NTG 402 delivers the notification message to the NTDA 403 via the NT4 interface 223 in step 415.

However, the conventional mobile broadcast system does not provide a method for generating a notification message for a notification event that occurred in the BSD/A or the BDS 206 and delivering a notification message generated for all notification events, or a method for sending a response upon receipt of the notification event/notification message.

Accordingly, there is a need for an improved method and system for delivering a notification event/notification message in a mobile broadcast system.

SUMMARY OF THE INVENTION

The present invention provides a method and system for delivering a notification event/notification message in a mobile broadcast system.

Further, the present invention provides a method and system for delivering a service guide source for generation of a service guide in a mobile broadcast system.

Moreover, the present invention provides a method and system for delivering provisioning information including purchase information for generation of a service guide in a mobile broadcast system.

According to one aspect of an exemplary embodiment of the present invention, there is provided a method for delivering a notification event for generation of a notification message for information provisioning to a subscriber receiving a broadcast service in a mobile broadcast system including a first apparatus for handling subscriber information management of the broadcast service and generation of the notification message and a second apparatus for handling delivery of the notification message over a broadcast channel or an interaction channel. The method comprises: sending, by the second apparatus, a notification event message for requesting generation of the notification message to the first apparatus according to at least one notification event; and generating, by the first apparatus, at least one notification message according to the at least one notification event, and sending a response message indicating generation end of the notification message to the second apparatus.

According to another aspect of an exemplary embodiment of the present invention, there is provided a mobile broadcast system for delivering a notification event for generation of a notification message for information provisioning to a subscriber receiving a broadcast service. The mobile broadcast system comprises a first apparatus for managing subscriber information of the broadcast service, handling generation of at least one notification message according to at least one notification event, and generating a response message indicating generation end of the notification message; and a second apparatus for sending a notification event message for requesting generation of the notification message to the first apparatus according to the at least one notification event, receiving the response message in response thereto, and then handling delivery of the notification message over a broadcast channel or an interaction channel.

According to further another aspect of an exemplary embodiment of the present invention, there is provided a method for delivering a notification message for information provisioning to a subscriber receiving a broadcast service in a mobile broadcast system including a first apparatus for handling subscriber information management of the broadcast service and generation of the notification message and a second apparatus for handling delivery of the notification message over a broadcast channel or an interaction channel. The method comprises: generating, by the first apparatus, a request message including information on a delivery channel over which a corresponding notification message is delivered, from among the broadcast channel and the interaction channel, and sending the request message to the second apparatus; and after receiving the request message, sending, by the second apparatus, a corresponding notification message over the broadcast channel or the interaction channel based on the delivery channel information.

According to yet another aspect of an exemplary embodiment of the present invention, there is provided a mobile broadcast system for delivering a notification message for information provisioning to a subscriber receiving a broadcast service. The mobile broadcast system includes a first apparatus for performing subscriber information management of the broadcast service, and generating a request message including information on a delivery channel over which a corresponding notification message is delivered, from among the broadcast channel and the interaction channel, and sending the request message to the second apparatus; and a second apparatus for, after receiving the request message, sending a corresponding notification message over the broadcast channel or the interaction channel based on the delivery channel information.

According to still another aspect of an exemplary embodiment of the present invention, there is provided a method for delivering a service guide source for generation of a service guide for broadcast service reception of a subscriber in a mobile broadcast system including a first apparatus for managing subscriber information of the broadcast service and a second apparatus for handling generation of the service guide and delivery of the service guide over a broadcast channel or an interaction channel. The method comprises: sending, by the first apparatus, a request message including at least one service guide source to the second apparatus; and generating, by the second apparatus, the service guide according to the at least one service guide source and sending a response message including the processing result to the first apparatus.

According to still another aspect of an exemplary embodiment of the present invention, there is provided a mobile broadcast system for delivering a service guide source for generation of a service guide for broadcast service reception of a subscriber. The mobile broadcast system includes a first apparatus for managing subscriber information of the broadcast service and generating a request message including at least one service guide source; and a second apparatus for generating the service guide based on the request message received from the first apparatus, sending a response message including the processing result to the first apparatus, and handling delivery of the service guide over a broadcast channel or an interaction channel.

BRIEF DESCRIPTION OF THE DRAWINGS

The above and other objects, features and advantages of the present invention will become more apparent from the following detailed description when taken in conjunction with the accompanying drawings in which.

Throughout the drawings, the same drawing reference numerals will be understood to refer to the same elements, features and structures.

DETAILED DESCRIPTION OF EXEMPLARY EMBODIMENTS

In the following description, a detailed description of known functions and configurations incorporated herein has been omitted for clarity and conciseness. Also, the matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention, In the following detailed description, exemplary embodiments of the present invention for achieving the above and other objects will be presented. Although names of the entities defined in 3$^{rd}$ Generation Partnership Project (3GPP) which is the asynchronous mobile communication standard, or BCAST of Open Mobile Alliance (OMA) which is the application standard for mobile terminals will be used for convenience, the standards and names should not limit the scope of the present invention, and the present invention can be applied to systems having similar technical background.

Before describing different exemplary embodiments of the present invention, a message schema table used for better understanding of the present invention will be described in accordance with an aspect of the present invention.

Figure 11:
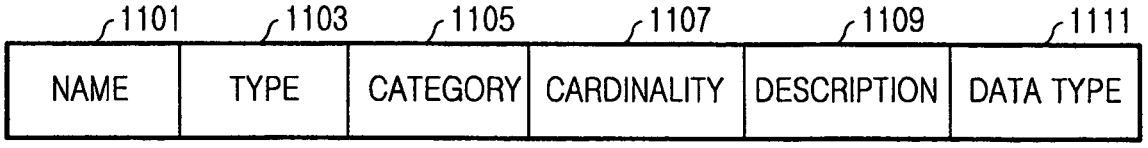
FIG. 11 is a diagram illustrating an exemplary structure of a message schema table applied to an exemplary embodiment of the present invention.

FIG. 11 illustrates an exemplary structure of a message schema table applied to the present invention in accordance with an exemplary embodiment thereof.

Referring to FIG. 11, 'Name' 1101 indicates names of elements and attributes constituting the corresponding message. 'Type' 1103 indicates whether the corresponding name 1101 has a type of an element or an attribute. Each element has values of E1, E2, E3 and E4. E1 represents an upper element for the whole message, E2 indicates sub-element of E1, E3 indicates a sub-element of E2, and E4 indicates a sub-element of E3. The attribute is indicated by A, and A indicates an attribute of the corresponding element. For example, A under E1 indicates an attribute of E1.

'Category' 1105 is used for indicating whether a corresponding element or attribute is mandatory or optional in a network N or a terminal T, and has a value M if the value is mandatory, and a value O if the value is optional. Therefore, the mandatory content in the network is indicated by 'NM', the mandatory content in the terminal is indicated by 'TM, the optional content in the network is indicated by 'NO', and the optional content in the terminal is indicated by 'OT'. 'Cardinality' 1107 indicates relations between the elements, and has values of '0', '0 . . . 1', '1', '0 . . . n', and '1 . . . n', where "0" means an optional relation, "1" means a mandatory relation, and 'n' means the possibility of having a plurality of values. For example, '0 . . . n' means the possibility that there is no corresponding element or there are n corresponding elements. 'Description' 1109 defines the meaning of the corresponding element or attribute. 'Data Type' 1111 indicates a data type of the corresponding element or attribute, i.e. a type of the program language used for generation. For example, Extensible Markup Language (XML) can be used.

Figure 5:
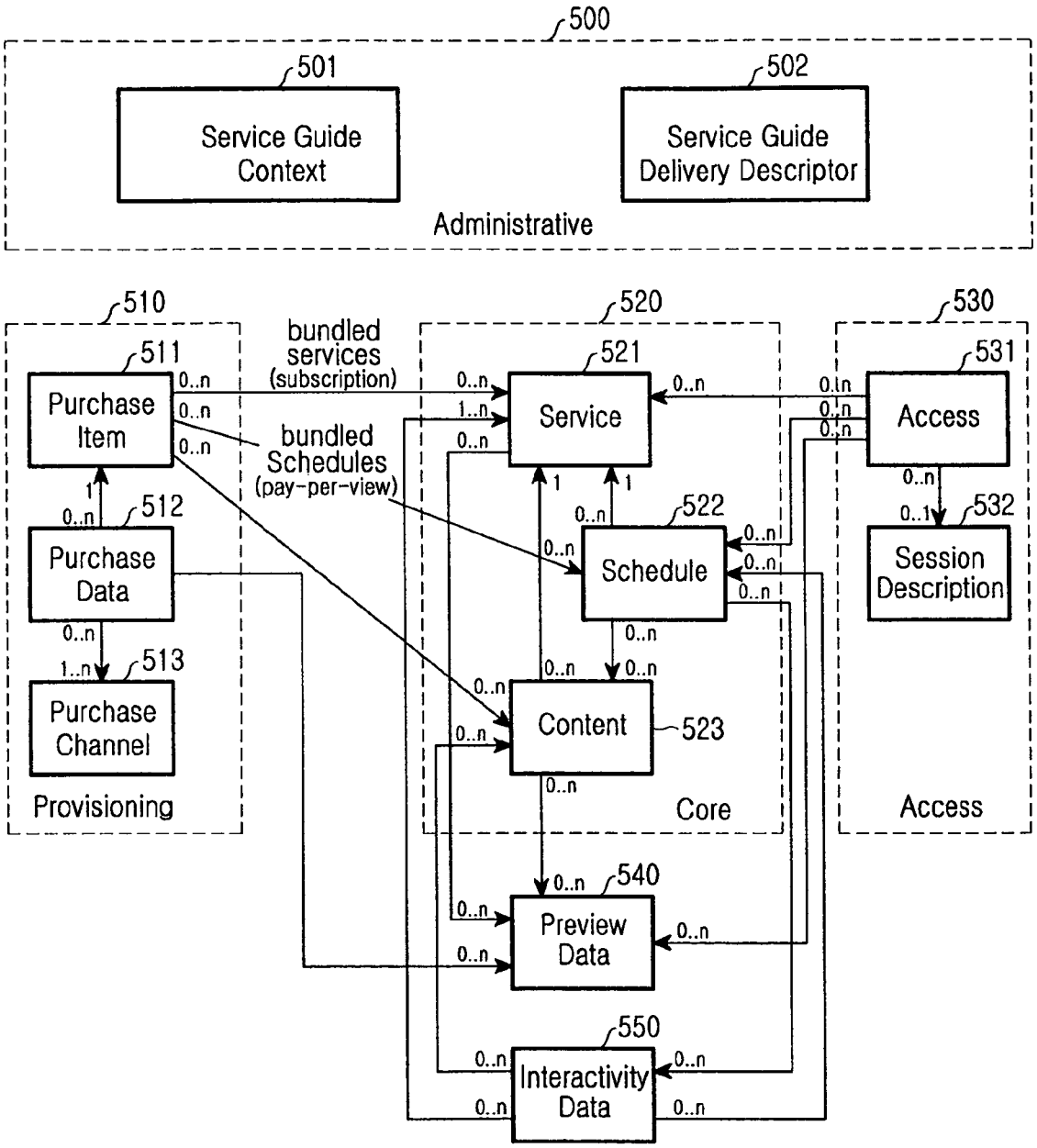
FIG. 5 is a diagram illustrating a structure of an illustrative service guide used for receiving a broadcast service in a mobile broadcast system to which an exemplary embodiment of the present invention is applied.

FIG. 5 is a diagram illustrating a structure of a service guide used for receiving a broadcast service in a mobile broadcast system to which the present invention is applied in accordance with an exemplary embodiment thereof. Shown is a data model of a service guide proposed for providing a broadcast service to a mobile terminal in the BCAST system. One service guide is composed of fragments having their own specific purposes, and the fragments are divided into 4 groups according to their usage, as shown in FIG. 5.

The exemplary service guide shown in FIG. 5 is composed of an Administrative group 500 for providing upper element information of the entire service guide, a Provisioning group 510 for providing subscription and purchase information of the service, a Core group 520 for providing core information of the service guide, such as service, content, and service scheduling, and an Access group 530 for providing access information for an access to the service or content. In FIG. 5, a solid line connecting the fragments means a cross-reference between the fragments.

The administrative group 500, a group for providing basic information needed by a mobile terminal to receive a service guide, includes a Service Guide Context fragment 501 and a Service Guide Delivery Descriptor (SGDD) fragment 502. The Service Guide Context fragment 501 provides a method in which the terminal can recognize a service guide, and also provides information on an operator or owner for distributing the service guide and on the location where the terminal can receive the service guide, and connection information with an SGDD for receipt of the service guide. The Service Guide Delivery Descriptor fragment 502 provides information on a delivery session where a Service Guide Delivery Unit (SGDU) containing a fragment, which is the minimum unit constituting the service guide, is located, and also provides grouping information for the SGDU and information on an entry point for receiving a notification message.

The Provisioning group 510 is a group for providing charging information for service reception. The Provisioning group 510 includes a Purchase Item fragment 511, a Purchase Data fragment 512, and a Purchase. Channel fragment 513. The Purchase Item fragment 511 provides a bundle such as service, content, and time to help a user subscribe or purchase the corresponding purchase item. The Purchase Data fragment 512 includes detailed purchase and subscription information such as charging information and promotion information for the service or service bundle. The Purchase Channel fragment 513 provides access information for subscription or purchase.

The Core group 520 is a group for providing information on the service itself. The Core group 520 includes a Service fragment 521, a Schedule fragment 522, and a Content fragment 523. The Service fragment 521, an upper aggregate of the contents included in the broadcast service as the center of the entire service guide, provides information on service content, genre, service location, and so on. The Schedule fragment 522 provides time information of each of the contents included in the Streaming and Downloading services. The Content fragment 523 provides a detailed description of the broadcast contents, target user group, service location, and genre.

The Access group 530 includes an Access fragment 531 and a Session Description fragment 532. The Access fragment 531 provides access-related information for allowing the user to view the service, and also provides a delivery method for the corresponding access session, and session information. The Session Description fragment 532 can also be included in the Access fragment 531, and provides location information in the URI form, so that the terminal can detect the corresponding session description information. In addition, the Session Description fragment 532 provides address information and codec information for the multimedia contents existing in the corresponding session.

The service guide information, as shown in FIG. 5, can further include a Preview Data fragment 540 that provides preview and icon for the service and content, and an Interactivity Data fragment 550, in addition to the foregoing four groups.

Figure 1:
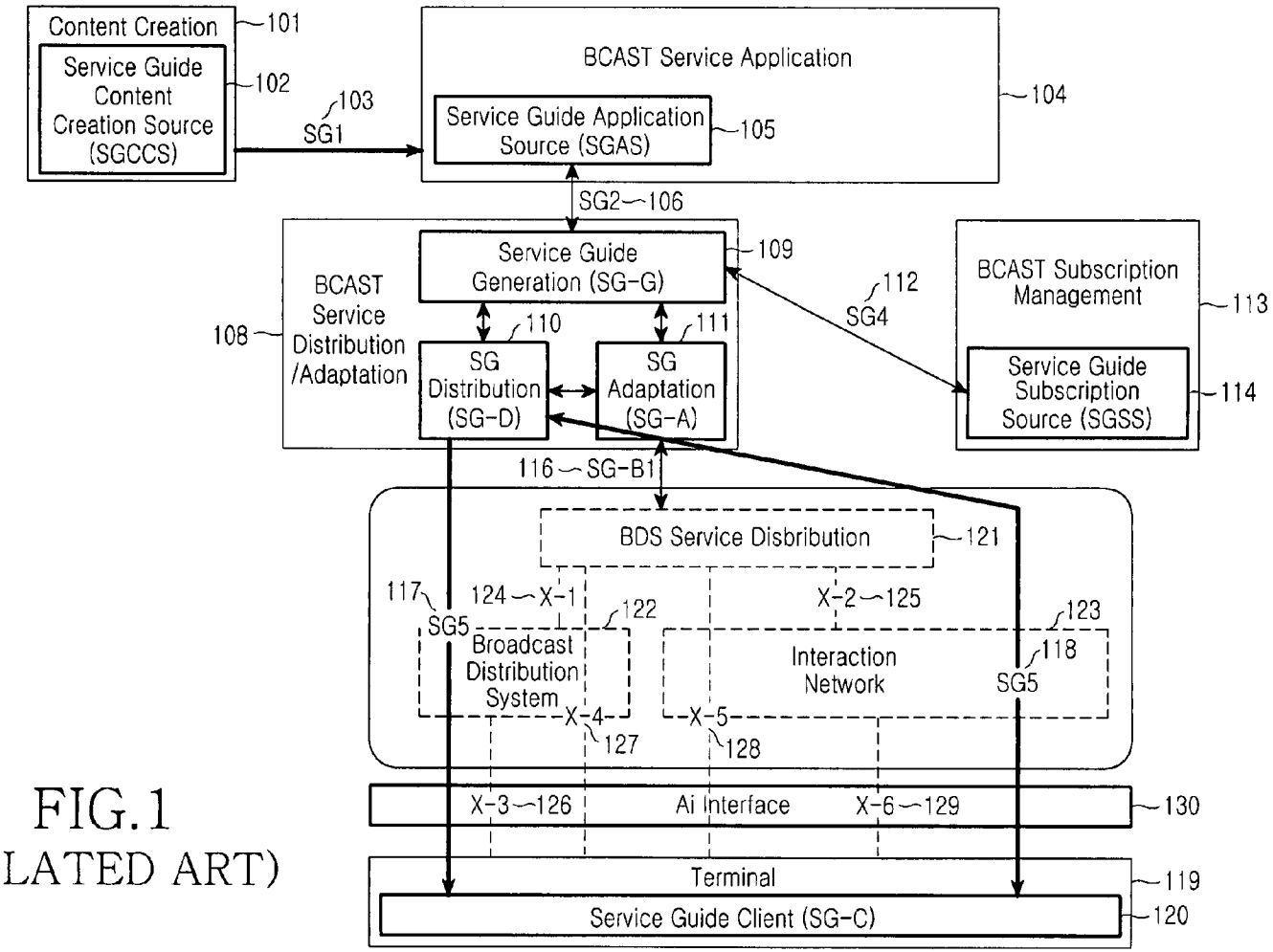
FIG.1 (RELATED ART)
FIG. 1 is a diagram illustrating exemplary architecture of a general mobile broadcast system that delivers a service guide to a mobile terminal.
Figure 2:
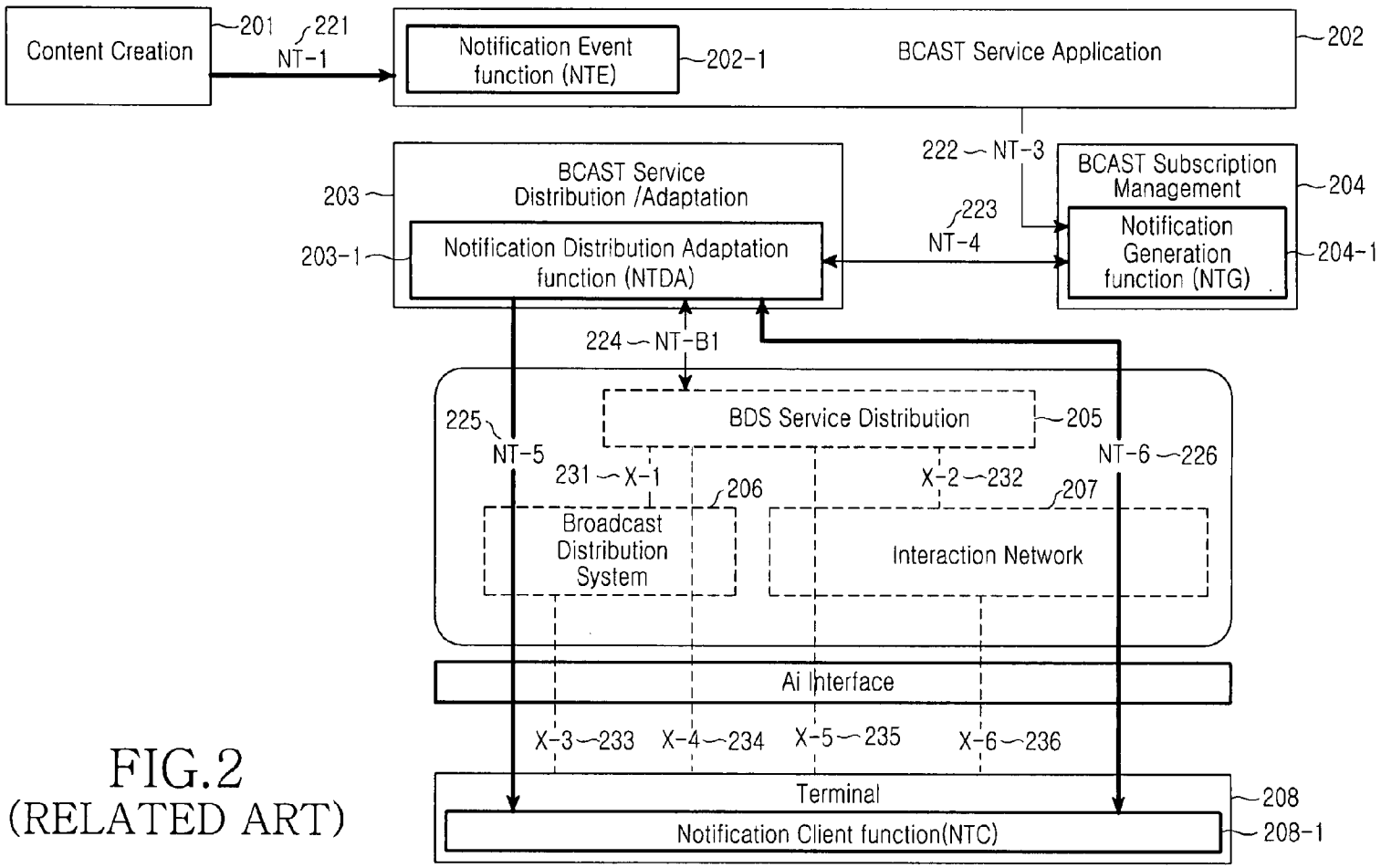
FIG.2 (RELATED ART)
FIG. 2 is a diagram illustrating notification architecture defined in BCAST service to deliver a notification message in the mobile broadcast system of FIG. 1.
Figure 3:
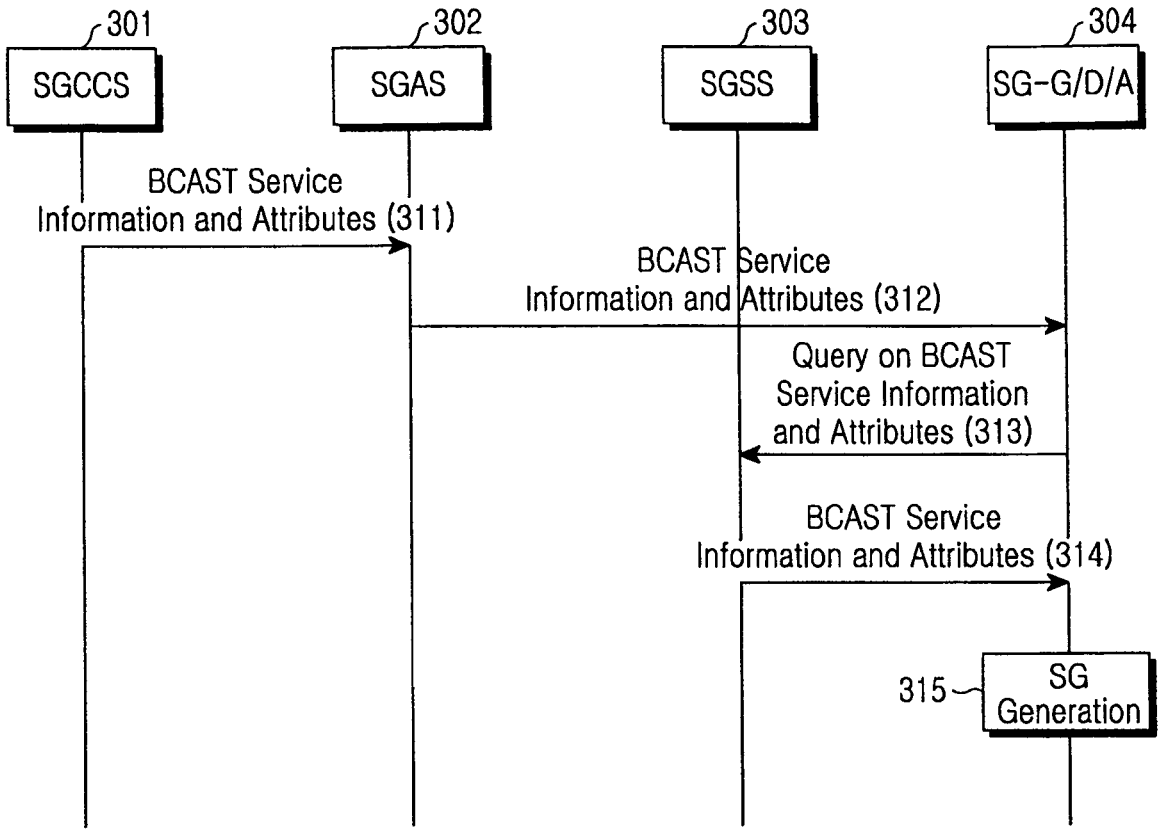
FIG.3 (RELATED ART)
FIG. 3 is a signaling diagram illustrating a message flow between logical entities for providing a service guide in a general mobile broadcast system.
Figure 4:
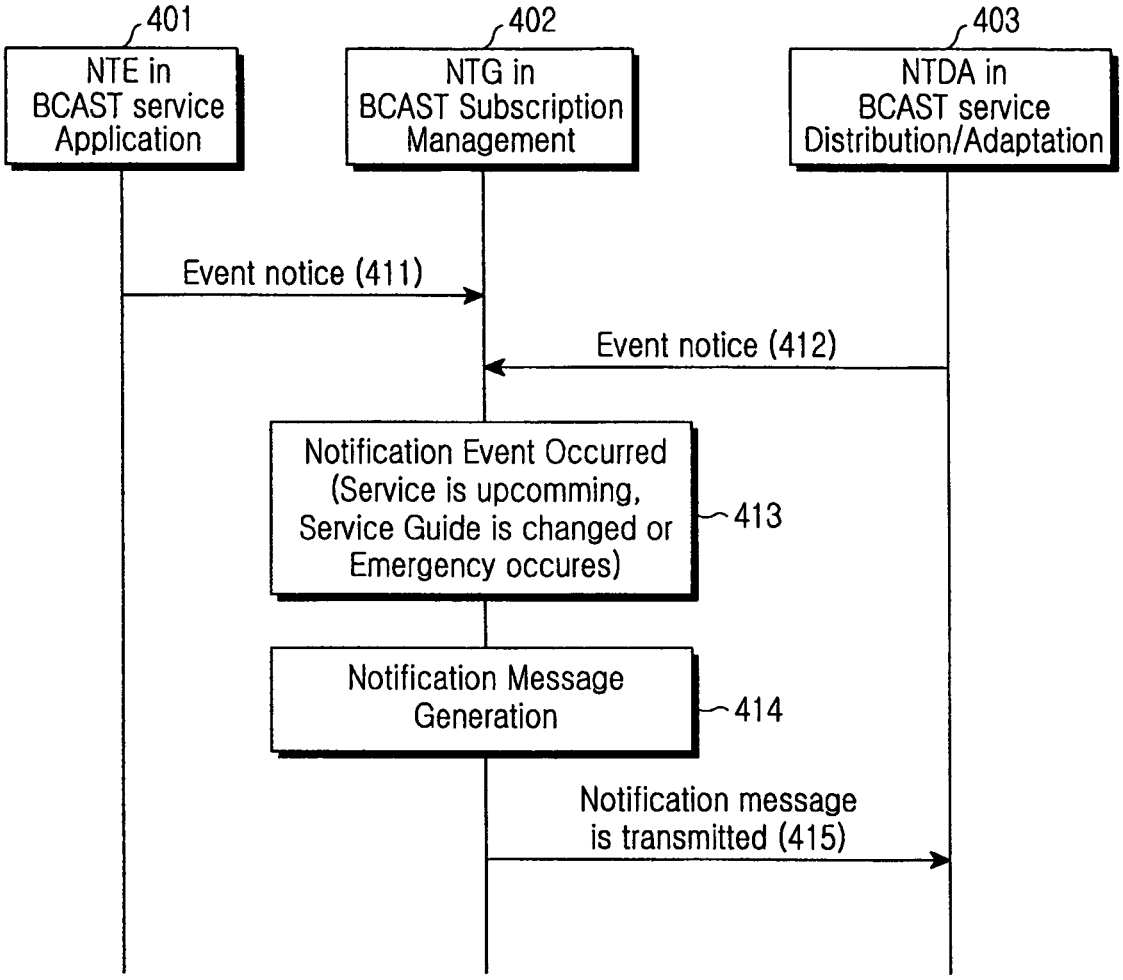
FIG.4 (RELATED ART)
FIG. 4 is a signaling diagram illustrating a message flow between logical entities for providing a notification message in a general mobile broadcast system.

The service guide of FIG. 5 is generated in the SG-G 109 of FIG. 1, and information (hereafter, provisioning information) of the Provisioning group 510 is provided by the SGSS 114 of FIG. 1. The corresponding provisioning information is delivered in step 314 of FIG. 3, and the information in step 314 may be delivered without the Query of step 313. However, because the information in step 313 is not necessarily required for obtaining the information for provisioning, the SGSS 114 should previously have the corresponding service and contents, or scheduling information, but this is not supported by the conventional system. Therefore, in accordance with an exemplary embodiment, the present invention resolves the need for an SG3 interface for information exchange between the SGAS and the SGSS. As described below, service/content and its scheduling information are provided from the SGAS to the SGSS through step 903.

Figure 6:
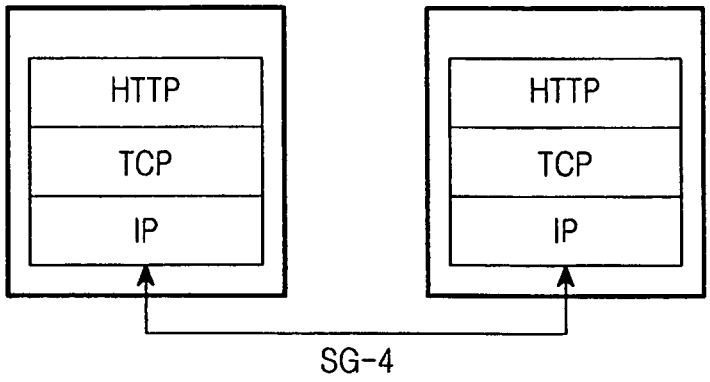
FIG. 6 is a diagram illustrating a protocol stack used for transmitting information related to a service guide in an SG-4 interface according to an exemplary embodiment of the present invention.

FIG. 6 is a diagram illustrating a protocol stack used for transmitting information related to a service guide in an SG-4 interface according to an exemplary embodiment of the present invention.

A message delivered over the SG-4 can be delivered in text or XML form. The corresponding message will be described in detail with reference to FIG. 7. The message over the SG-4 is delivered using IP, TCP and HTTP, and the SG-G in the BSD/A sends a Provisioning Information Request message to the SGSS in the BSM through an HTTP POST. After receiving the message from the SG-G, the SGSS can transmit the provisioning information along with an HTTP RESPONSE message, or can send a result message through the HTTP POST.

Figure 7:
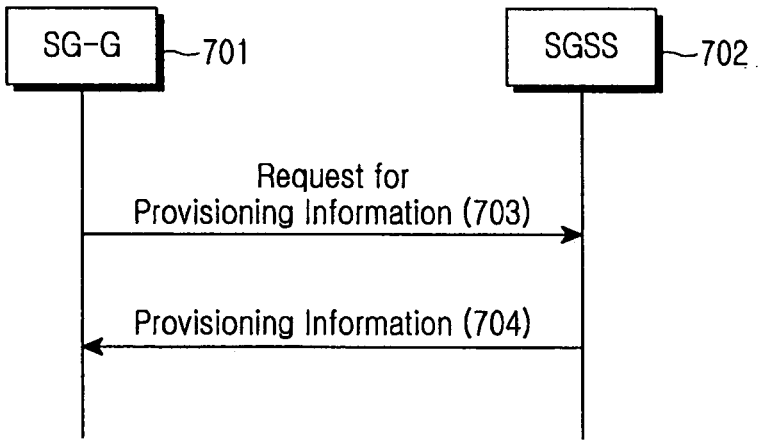
FIG. 7 is a signaling diagram illustrating a process of transmitting a Provisioning Information Request message over an SG-4 according to an exemplary embodiment of the present invention.

FIG. 7 is a signaling diagram illustrating a process of transmitting a Provisioning Information Request message over an SG-4 according to an embodiment of the present invention.

In step 703, an SG-G 701 sends a Provisioning Information Request message including ServiceId, ContentId, and ScheduleId to an SGSS 702. The provisioning information, as described in FIG. 5, includes charging information for the subscriber's service reception. The Provisioning Information Request message provided in step 703 is shown in Table 6 below. In step 704, the SGSS 702 generates provisioning information of the service guide with the information received from the SG-G 701, and sends the corresponding information to the SG-G 701. When the provisioning information is immediately generated and delivered, the SGSS 702 can send a result message along with an HTTP Response message in response to the request message received in step 703. If time is required for generating provisioning information of the service guide, the SGSS 702 can notify the result message to the SG-G 701 through the HTTP POST using ProvReqId and BSDAAddress at a provisioning information generation complete time after closing the session between the SG-G 701 and the SGSS 702. The details of the result message are shown in Tables 7A and 7B below. In the response message of Table 7B, PurchaseItem succeeds to PurchaseItemInfo of Tables 8A through 8E, PurchaseData succeeds to PurchaseDataInfo of Tables 9A through 9F, and PurchaseChannel succeeds to PurchaseChannelInfo of Tables 10A through 10E. As for the response to the SG-G request in step 704, responses to several requests of the SG-G can be sent from the SGSS to the SGAS using one message.

TABLE 6

| Name | Type | Category | Cardinality | Description | Data Type |
|---|---|---|---|---|---|
| ProvReq | | | | Specifies the request message to deliver Provisioning Section of Service Guide. Contains the Following attributes: ProvReqId Contains the following elements: Service Content Schedule | |
| ProvReqId | A | M | 1 | Identifier of ProvReq which is the message for SG-G to request Provisioning Information | unsigned Int (32 bits) |
| BSDAAddress | A | M | 1 | BSDA Address to receive the response of this request. | AnyURI |
| ServiceId | E1 | O | 0 . . . N | ID of Service Fragments | AnyURI |
| ContentId | E1 | O | 0 . . . N | ID of Content Fragments | AnyURI |
| ScheduleId | E1 | O | 0 . . . N | ID of Schedule Fragments | AnyURI |
| PreviewDataId | E1 | O | 0 . . . N | ID of PreviewData Fragments | |

TABLE 7A

| Name | Type | Category | Cardinality | Description | Data Type |
|---|---|---|---|---|---|
| ProvRes | E | | | Specifies the Response message for ProvReq. Contains the following elements: ProvReqId | |
| ProvReqId | E1 | M | 0 . . . N | Identifier of ProvReqID Contains the following attributes: Response Contains the following elements: Provisioning | unsigned Int (32bits) |
| Response | A | M | 1 | Specifies the result how ProvReq is handled in SGSS. If Response = 0, Provisioning Fragments of Service Guide are generated and Provisioning Fragments SHALL be included with this Response Message. If Response = 1, Provisioning Fragments Generation has failed and Retransmission is requested. | Integer (8bits) |

TABLE 7B

| | | | | |
|---|---|---|---|---|
| Provisioning | E2 | O | 0 . . . 1 | Specifies the Provisioning Fragments for the service guide. Contains the following elements: |

TABLE 7B-continued

| | | | | | |
|---|---|---|---|---|---|
| | | | | PurchaseItem PurchaseData PurchaseChannel | |
| PurchaseItem | E3 | M | 1 . . . N | Specifies the PurchaseItem | Purchase ItemInfo |
| PurchaseData | E3 | O | 0 . . . N | Specifies the PurchaseData | Purchase DataInfo |
| PurchaseChannel | E3 | M | 1 . . . N | Specifies the PurchaseChannel | Purchase ChannelInfo |

TABLE 8A

| Name | Type | Category | Cardinality | Description | Data Type |
|---|---|---|---|---|---|
| PurchaseItemInfo | E | | | PurchaseItem fragment Contains the following attributes: Id version validFrom validTo Weight Closed Contains the following sub-elements: ExtensionURL ServiceIDRef ScheduleIDRef ContentIDRef PurchaseItemIDRef Name Description ParentalRating PurchaseDataIDRef | |
| id | A | M | 1 | ID of the PurchaseItem fragment, globally unique | anyURI |
| version | A | M | 1 | Version of this fragment. The newer version overrides the older one as soon as it has been received. | unsigned int (32 bits) |

TABLE 8B

| | | | | | |
|---|---|---|---|---|---|
| validFrom | A | O | 0 . . . 1 | The first moment when this fragment is valid. If not given, the validity is assumed to have started at some time in the past. Note: the validFrom time of the PurchaseItem SHALL be no earlier than the latest of the validFrom time(s) of the referenced PurchaseItem(s). | Integer (32 bits) expressed as NTP time |
| validTo | A | O | 0 . . . 1 | The last moment when this fragment is valid. If not given, the validity is assumed to end in undefined time in the future. Note: the validTo time of the PurchaseItem SHALL be no later than the earliest of the validTo time(s) of the referenced PurchaseItem(s) | Integer (32 bits) expressed as NTP time |
| Weight | A | NO/TM | 1 | Intended order of display of this purchase item relative to other purchase items as seen by the end user. The order of display is by increasing Weight value (i.e., purchase item with lowest Weight is displayed first). | unsigned Int (32 bits) |

TABLE 8C

| | | | | | |
|---|---|---|---|---|---|
| Closed | A | NO/TM | 0 . . . 1 | If present and value = 1, it indicates the Purchase Item is closed to new subscribers. | Boolean |
| Extension URL | E1 | O | 0 . . . N | URL containing additional information related to this fragment in a web page. The terminal can fetch further information by accessing this URL. | AnyURI |
| ServiceID Ref | E1 | O | 0 . . . N | References to the Service fragments which belong to this PurchaseItem. Note: a Service fragment can be referenced by multiple PurchaseItems. Contains attributes: PresentationWindowID The PresentationWindowIDs declared in this attribute SHALL be the complete collection or a subset of the PWId's declared in the ScheduleID fragment, to which this reference belongs. | anyURI |

TABLE 8D

| | | | | | |
|---|---|---|---|---|---|
| PresentationWindowID | A | NO/TM | 0 . . . N | Relation reference to the PresentationWindowID to which the access fragment belongs. | anyURI |
| ScheduleIDRef | E1 | O | 0 . . . N | References to the Schedule fragments which belong to this PurchaseItem. Note: a Schedule fragment can be referenced by multiple PurchaseItems. | anyURI |
| ContentID Ref | E1 | O | 0 . . . N | References to the Content fragments which belong to this PurchaseItem. Note: a Content fragment can be referenced by multiple PurchaseItems. | anyURI |
| PurchaseItemIDRef | E1 | NO/TM | 0 . . . N | References to the PurchaseItem fragments which belong to this PurchaseItem by reference Note: a PurchaseItem fragment can be referenced by multiple PurchaseItems. Note: the depth of the PurchaseItem tree SHALL not be more than three. | anyURI |

TABLE 8E

| | | | | | |
|---|---|---|---|---|---|
| Name | E1 | M | 1 . . . N | Name of the PurchaseItem, possibly in multiple languages. The language is expressed using built-in XML attribute xml:lang with this element. | String |
| Description | E1 | NO/TM | 0 . . . N | Description of the purchase item, possibly in multiple languages. The language is expressed using built-in XML attribute xml:lang with this element. | String |

TABLE 8E-continued

| | | | | | |
|---|---|---|---|---|---|
| ParentalRating | E1 | O | 0 . . . 1 | The rating level defining criteria parents may use to determine whether the associated item is suitable for access by children, defined according to the regulatory requirements of the service area This determines the rating level age limit for service purchase, not the rating level age limit of the actual service consumption. | String |

TABLE 9A

| Name | Type | Category | Cardinality | Description | Data Type |
|---|---|---|---|---|---|
| PurchaseDataInfo | E | O | 0 . . . N | PurchaseData fragment Contains the following attributes: id version validFrom validTo Contains the following sub-elements: ExtensionURL Description PurchaseItemIDRef PurchaseChannelIDRef PriceInfo PreviwDataIDRef PromotionInfo | |
| id | A | M | 1 | ID of the PurchaseData fragment, globally unique | anyURI |
| version | A | M | 1 | Version of this fragment. The newer version overrides the older one as soon as it has been received. | unsigned Int (32 bits) |

TABLE 9B

| | | | | | |
|---|---|---|---|---|---|
| validFrom | A | O | 0 . . . 1 | The first moment when this fragment is valid. If not given, the validity is assumed to have started at some time in the past | Integer (32 bits) expressed as NTP time |
| validTo | A | O | 0 . . . 1 | The last moment when this fragment is valid. If not given, the validity is assumed to end in undefined time in the future. | Integer (32 bits) expressed as NTP time |
| Extension URL | E1 | O | 0 . . . N | URL containing additional information related to this fragment in a web page. The terminal can fetch further information by accessing this URL. | AnyURI |
| Description | E1 | NO/ TM | 0 . . . N | Description of the purchase channel, possibly in multiple languages. The language is expressed using built-in XML attribute xml:lang with this element. | String |
| PurchaseItemIDRef | E1 | M | 1 | The PurchaseItem to which this PurchaseData applies to. | anyURI |

TABLE 9C

| | | | | | |
|---|---|---|---|---|---|
| PurchaseChannelIDRef | E1 | M | 1 . . . N | The PurchaseChannel through which the identified PurchaseItem can be obtained | anyURI |
| PriceInfo | E1 | M | 1 . . . N | If the price is not given, it will be negotiated with the user as part of the purchase transaction. In this case, the PurchaseData fragment merely reflects that a certain purchase item can be purchased from the PurchaseChannel. Contains the following sub-elements: SubscriptionUnit UnitText Price | |
| SubscriptionUnit | E2 | M | 1 | Description of time unit of subscription Attributes: type value unit | |

TABLE 9D

| | | | | | |
|---|---|---|---|---|---|
| Type | A | M | 1 | Subscription type | Integer |
| Value | A | M | 1 | Number of units | Integer |
| Unit | A | M | 1 | Time unit | Integer |
| UnitText | E2 | M | 1 . . . N | Time unit in which the duration is expressed to the user, possibly in multiple languages. The language is expressed using built-in XML attribute xml:lang with this element. | String |
| Price | E2 | M | 0 . . . N | The price of the purchase item for the defined duration Attributes: currency value | |

TABLE 9E

| | | | | | |
|---|---|---|---|---|---|
| currency | A | M | 1 | Currency of price | ISO 4217 international currency codes |
| value | A | M | 1 | Value in the designed currency | Integer |
| PreviewDataIDRef | E1 | O | 0 . . . N | Reference to the PreviewData fragment which specifies an icon, pictogramme, animation or audio. Attribute: usage | anyURI |
| usage | A | M | 1 | Possible values: background, icon (e.g.) | Integer (8 bits) |
| PromotionInfo | E1 | O | 0 . . . N | Information of the promotion activities/coupons related to the PurchaseItem Contains the following attributes: id validFrom validTo Contains the following sub-elements: Title TargetUserProfile Description URL | |

TABLE 9F

| | | | | | |
|---|---|---|---|---|---|
| Id | A | M | 1 | Identifier of one certain PromotionInfo, unique for BSM. PromotionID may be used in the purchase process to identify the specific promotion | unsigned Int |
| validFrom | A | O | 0 . . . 1 | Start of validity; if not given, the start of validity is assumed in the past | Integer (32 bits) expressed as NTP time |

TABLE 9F-continued

| | | | | | |
|---|---|---|---|---|---|
| validTo | A | O | 0 . . . 1 | End of validity; if not given, the end of validity is assumed in the distant future, and the end time can be specified later by updating the object | Integer (32 bits) expressed as NTP time |
| Title | E2 | M | 1 | Title of the PromotionInfo | String |
| TargetUserProfile | E2 | O | 0 . . . 1 | Profile of the users who the service or content is targeting at. For example, age, gender, occupation, and so on. | |

TABLE 9G

| | | | | | |
|---|---|---|---|---|---|
| Description | E2 | NO/TM | 0 . . . 1 | Description or explanation about the PromotionInfo. Either Description or URL or both of them should be specified by the BSM to represent the detailed information on this PromotionInfo. | String |
| URL | E2 | NO/TM | 0 . . . 1 | URL containing the detailed promotional information (e.g. information about coupon sponsors, server location for purchases by using coupons). Either Description or URL or both of them should be specified by the BSM to represent the detailed information on this PromotionInfo. | AnyURI |

TABLE 10A

| Name | Type | Category | Cardinality | Description | Data Type |
|---|---|---|---|---|---|
| PurchaseChannel | B | O | 0 . . . N | PurchaseChannel fragment<br>Contains the following attributes:<br>id<br>version<br>validFrom<br>validTo<br>LocalFlag<br>RightsIssuerURI<br>Selector<br>Contains the following sub-elements:<br>ExtensionURL<br>Name<br>PortalURL<br>Description<br>Connection<br>ContactInfo | |
| id | A | M | 1 | ID of the PurchaseChannel fragment, globally unique | anyURI |
| version | A | M | 1 | Version of this fragment. The newer version overrides the older one as soon as it has been received. | unsigned Int (32 bits) |

TABLE 10B

| | | | | | |
|---|---|---|---|---|---|
| validFrom | A | O | 0 . . . 1 | The first moment when this fragment is valid. If not given, the validity is assumed to have started at some time in the past | Integer (32 bits) expressed as NTP time |
| validTo | A | O | 0 . . . 1 | The last moment when this fragment is valid. If not given, the validity is assumed to end in undefined time in the future. | Integer (32 bits) expressed as NTP time |
| LocalFlag | A | M | 1 | If true, indicates that the BSM advertises the availability and purchase information completely in the service guide | Boolean |

TABLE 10B-continued

| | | | | | |
|---|---|---|---|---|---|
| RightsIssuerURI | A | NO/TO | 1 | ID of the fights issuer associated with the BSM (needed to allow unconnected devices to identify the RI service that may be operated by their Home BSM). If the service protection or content protection system is based on OMA DRM2.0, RightsIssuerURI SHALL be specified. | AnyURI |

TABLE 10C

| | | | | | |
|---|---|---|---|---|---|
| Selector | A | M | 1 | Allows a terminal to determine which purchase channel to use, among the purchase channels that are announced in the SG. Attributes: type (e.g. possible value: "SIMCode") Note: Purchase channel needs to be provided by the BCAST Service Provider. | String |
| ExtensionURL | E1 | O | 0 . . . N | URL containing additional information related to this fragment in a web page. The terminal can fetch further information by accessing this URL. | AnyURI |
| Name | E1 | M | 1 . . . N | Name of the Purchase Channel, possibly in multiple languages. The language is expressed using built-in XML attribute xml:lang with this element. | String |

TABLE 10D

| | | | | | |
|---|---|---|---|---|---|
| PortalURL | E1 | O | 0 . . . 1 | URL for the BSM, on which all purchase transactions can be made | AnyURI |
| Description | E1 | NO/TM | 0 . . . N | Description of the purchase channel, possibly in multiple languages. The language is expressed using built-in XML attribute xml:lang with this element. | String |
| Connection | E1 | M | 1 . . . N | Allows a terminal to construct a purchase request and send it to the purchase channel. In case multiple connection options are specified, it is up to the terminal to choose, e.g., to use IP (over GPRS), with SMS as a fallback option. Contains the following sub-elements: PurchaseURL | |

TABLE 10E

| | | | | | |
|---|---|---|---|---|---|
| PurchaseURL | E2 | M | 1 . . . N | The URL to which the purchase request should be addressed. Contains the following attribute: Bearer | AnyURI |
| Bearer | A | M | 1 | Bearer supporting this purchase channel | Integer |
| ContactInfo | E1 | O | 0 . . . 1 | A text string that indicates to a user how to contact a BSM to initiate an out-of-band purchase transaction (e.g. phone number, URL and so on) | String |

Figure 8:
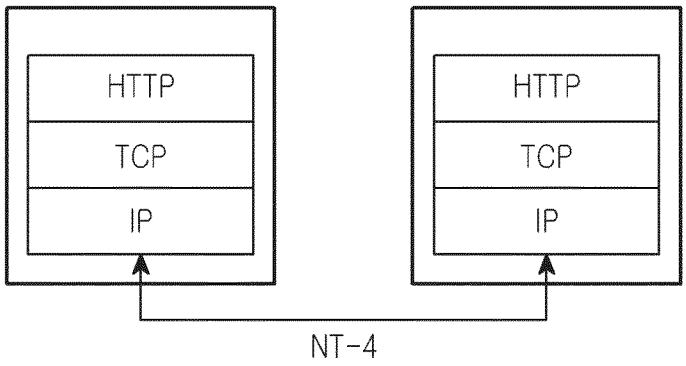
FIG. 8 is a diagram illustrating a protocol stack used for exchanging a notification event/notification message over an NT-4 interface according to an exemplary embodiment of the present invention.

FIG. 8 illustrates a protocol stack used for transmitting/receiving a notification event/notification message over an NT-4 interface according to an embodiment of the present invention.

The message delivered over the NT-4 can be delivered in text or XML form. The corresponding message will be described in detail with reference to FIG. 9 or 10. The message over the NT-4 is transmitted using IP, TCP and HTTP, and the NTDA in the BSD/A can request generation of a notification message by sending a notification event message to the NTG in the BSM through an HTTP POST. In response to the notification event message, the NTG in the BSM generates a notification message and sends the notification message to the NTDA, thereby requesting delivery of the notification message to the terminal. In addition, upon receipt of the notification event message, the NTG can transmit the result for the request of the notification event to the NTDA along with an HTTP RESPONSE message, or send a result message through the HTTP POST.

Figure 9:
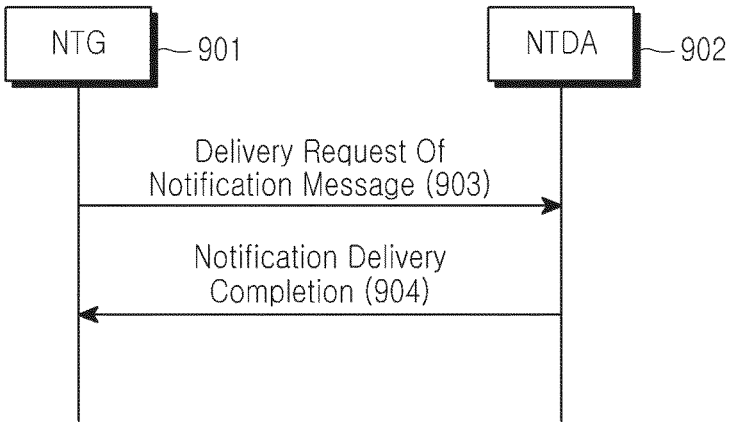
FIG. 9 is a signaling diagram illustrating a process of transmitting a notification message over an NT-4 interface according to an exemplary embodiment of the present invention.

FIG. 9 is a signaling diagram illustrating a process of transmitting a notification message over an NT-4 interface according to an embodiment of the present invention.

In step 903, an NTG 901 sends a Delivery Request message to an NTDA 902 to request delivery of a notification message to a terminal. The exemplary Delivery Request (NTDReq) message provided in step 903 is shown in Tables 11A and 11B. When the Delivery Request message in Tables 11A and 11B for the notification message is generated, an actual notification message is attached to the Delivery Request message by MIME Encoding before being delivered. In relation to the corresponding notification message, the NTG 901 specifies Priority indicating a delivery priority and Target Address to which it will deliver the notification message, and delivers the Delivery Request message to the NTDA 902. The NTDA 902 checks a corresponding attribute for the notification message, delivers the notification message according to the priority, and also delivers the notification message to the user according to the Target Address. In connection with the TargetAddress, the notification message is delivered to a user using a particular service through an AccessID connected to the corresponding service, and can also be delivered to a plurality of users through a particular Multicast IP Address.

The BSD/A can receive the AccessID or the Multicast IP Address from the BSM via the NTDA or the SG-G. In step 904, the NTDA 902 delivers the notification message received from the NTG 901 to the terminal via an available BDS, and then sends a message indicating delivery end of the notification message to the NTG 901. When the notification message is immediately delivered, the NTDA 902 can send a result message indicating delivery end of the notification message along with an HTTP Response message in response to the request message received in step 903. Otherwise, if time is required for delivering the notification message, the NTDA 902 can close the session to the NTG 901 and then deliver a result message indicating delivery end of the notification message to the NTG 901 using NTDReqId and BSMAddress of the NTDReq message received in step 903 and the HTTP POST at a delivery end time of the notification message. The details of the result message are shown in Table 12 below.

TABLE 11A

| Name | Type | Category | Cardinality | Description | Data Type |
|---|---|---|---|---|---|
| NTDReq | E | | | Specifies the Request message of Notification Message Delivery from NTG to NTDA. Contains the following elements: NTDId BSMAddress | |
| NTDReqId | A | M | 1 | Identifier of NTDReq | unsigned Int (32 bits) |
| BSMAddress | A | M | 1 | BSM Address to receive the response of this request. | AnyURI |
| NotificationId | A | M | 1 | Identifier of Notification Message ID generated by NTG. | AnyURI |

TABLE 11B

| | | | | | |
|---|---|---|---|---|---|
| Priority | A | M | 1 | Defines the delivery priority of Notification Message If Priority = 0, it means high prioriity If Priority = 1, it means general message. | Boolean |
| Target-Address | A | O | 0 . . . 1 | TargetAddress to delivery notification message. If not specified, Notification message SHALL be delivered to all user using SGSS. If TargetAddress is specified with AccessID or specific Address, Notification message SHALL be delivered to specific user related with AccessID or specific address. | AnyURI |
| Notifi-cation Message | E1 | M | 1 | MIME Type. Notification Message SHALL be embedded in this element. | |

TABLE 12

| Name | Type | Category | Cardinality | Description | Data Type |
|---|---|---|---|---|---|
| NTDRes | E | | | Specifies the Response message for NTDReq. Contains the following elements: NTDReqId | |
| NTDReqId | E1 | M | 0 . . . N | Identifier of NTDReq Contains the following attributes: Response | unsigned Int (32 bits) |
| Response | A | M | 1 | Specifies the result how NTDReq is handled in BSDA. If Response = 0, Notification Message is delivered. If Response = 1, Notification Message Delivery is failed and Retransmission is requested. | Integer (8 bits) |

Figure 10:
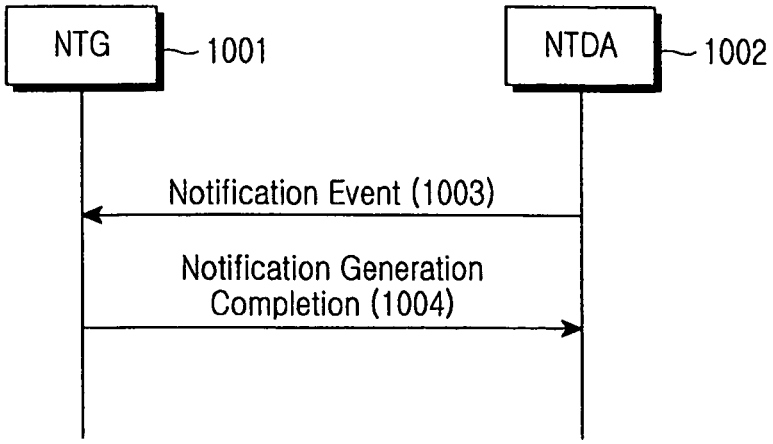
FIG. 10 is a signaling diagram illustrating a process of transmitting a notification event over an NT-4 interface according to an exemplary embodiment of the present invention.

FIG. 10 is a signaling diagram illustrating a process of transmitting a notification event over an NT-4 interface according to an embodiment of the present invention.

In step 1003, an NTDA 1002 sends a message for requesting generation of a notification message, i.e. a notification event message, to an NTG 1001. The exemplary notification event message delivered to the NTG 1001 in step 1003 is shown in Tables 13A through 13I below. The notification event generated in the NTDA 1002 corresponds to an event occurring in the Broadcast Distribution System (BDS) or the NTDA 1002. In step 1004, the NTG 1001 generates a notification message based on the notification event information received from the NTDA 1002, and sends a response message indicating generation end of the notification message to the NTDA 1002. If the notification message is immediately generated in the NTDA 1002 and then delivered to the NTG 1001, the NTG 1001 can send a result message along with an HTTP Response message in response to the request message received in step 1003. Otherwise, if time is required for generating the notification message, the NTG 1001 can close the session to the NTDA 1002 and then send a result message to the NTDA 1002 using NTDAEReqId and BSAAddress of the NTDAEReq message received in step 1003 and the HTTP POST at the generation end time of the notification message. The details of the result message are shown in Table 14 below.

TABLE 13A

| Name | Type | Category | Cardinality | Description | Data Type |
|---|---|---|---|---|---|
| NTDAEReq | E | | | Specifies the Request message of Notification Event from NTDA to NTG. Contains the following elements: NTDAEReqId BSAAddress | |
| NTDAEReqId | A | M | 1 | Identifier of Notification Event from BSD/A | unsigned Int (32 bits) |
| BSDAAddress | A | M | 1 | BSDA Address to receive the response of this request. | AnyURI |
| NotificationEvent | E1 | M | 1 . . . N | Specifies the Notification Event from CC Contains the following attributes: Priority TargetAddress NotificationType Validity Contains the following elements: Name Description Priority ExtensionURL SessionInformation MediaInformation | |

TABLE 13B

| | | | | | |
|---|---|---|---|---|---|
| Priority | A | M | 1 | Defines the delivery priority of Notification Message.<br>If Priority = 0, it means high prioriity<br>If Priority = 1, it means general message.<br>This elements will be used when generating NTDReq | Boolean |
| Target-Address | A | O | 0 . . . 1 | TargetAddress to delivery notification message.<br>If not specified, Notification message SHALL be delivered to all user using SGDD.<br>If TargetAddress is specified with AccessID or specific Address, Notification message SHALL be delivered to specific user related with AccessID or specific address.<br>This elements will be used when generating NTDReq | AnyURI |

TABLE 13C

| | | | | | |
|---|---|---|---|---|---|
| Notification-Type | A | M | 1 | Notification Type:<br>If NotificationType = 0, this message is user-oriented message, such as notice from SP, Multimedia message, emergency, and so on.<br>If NotificationType = 1, this message is terminal-oriented message, such as start of service or file download, and so on.<br>Other NotificationType can be determined due to service providers, operators, or broadcasters' purpose | Integer |
| Validity | A | O | 0 . . . 1 | Valid time of Notification message fragment.<br>If Validity is specified, Notification message should be expired at the specified time. | Integer (32 bits) expressed as NTP time |

TABLE 13D

| | | | | | |
|---|---|---|---|---|---|
| Name | E2 | O | 0 . . . N | Name or title of notification message, possibly in multiple languages.<br>The language is expressed using built-in XML attribute xml:lang with this element. | String |
| Description | E2 | O | 0 . . . N | Description or Messages of Notification, possibly in multiple languages<br>The language is expressed using built-in XML attribute xml:lang with this element | String |
| Priority | E2 | M | 1 | Defines the priority of this notification event. This information applied to generate presentation type of Notification Message. | Integer |
| Extension URL | E2 | O | 0 . . . N | URL containing additional information related to notification message | AnyURI |

TABLE 13E

| | | | | | |
|---|---|---|---|---|---|
| Session-Information | E2 | O | 0 . . . N | Defines the delivery session information, objects or fragments information delivered through the indicated session, and URI as alternative method for delivery. After receiving Notification Message with SessionInformation, Terminal would access the relevant session specified by SessionInformation and take a proper action like receiving contents.<br>Contains the following attributes:<br>ValidFrom<br>ValidTo<br>UsageType<br>Contains the following elements:<br>DeliverySession<br>TransportObjectID<br>AlternativeURI | |
| ValidFrom | A | O | 0 . . . 1 | The first moment when the session for terminal to receive data is valid. | Integer (32 bits) expressed as NTP time |
| ValidTo | A | O | 0 . . . 1 | The last moment when the session for terminal to receive data is valid | Integer (32 bits) expressed as NTP time |

TABLE 13F

| | | | | | |
|---|---|---|---|---|---|
| Usage-Type | A | O | 0 . . . 1 | Defines the type of the object transmitted through the indicated delivery session.<br>If UsageType = 0, the indicated delivery session would be used for file delivery.<br>If UsageType = 1, the service would start through the indicated delivery session at scheduled.<br>Other PresentationType can be determined due to service providers, operators, or broadcasters' purpose | Integer |
| Delivery-Session | E3 | O | 0 . . . 1 | Target delivery session information indicated by the notification message.<br>Contains the following attributes:<br>SourceIP<br>TransportSessionID | |
| SourceIP | A | M | 1 | Source IP address of the delivery session | String |

TABLE 13G

| | | | | | |
|---|---|---|---|---|---|
| TransportSessionID | A | M | 1 | Identifier of target delivery session | unsigned Short (16 bits) |
| TransportObjectID | E3 | O | 0 . . . N | The transport object ID(TOI) of the object transmitting through the indicated delivery session including the following Fragment Elements | unsigned Int(32 bits) |
| Alternative URI | E3 | O | 0 . . . 1 | Alternative URI for receiving the object via the interaction channel. If terminal cannot access the indicated delivery session, terminal can be received the object associated with the notification message by AlternativeURI. | AnyURI |
| MediaInformation | E2 | O | 0 . . . 1 | Media Information which is needed to construct multimedia notification messages. Contains the following elements: Picture Video Audio | |

TABLE 13H

| | | | | | |
|---|---|---|---|---|---|
| Picture | E3 | O | 0 . . . N | Defines how to obtain a picture and MIME type. Contains the following elements: MIMEtype PictureURI | |
| MIMEtype | A | O | 0 . . . 1 | MIME type of Picture | String |
| PictureURI | A | O | 0 . . . 1 | The URI referencing the picture | AnyURI |
| Video | E3 | O | 0 . . . N | Defines how to obtain a video and MIME type. Contains the following elements: MIMEtype VideoURI | |

TABLE 13H-continued

| | | | | | |
|---|---|---|---|---|---|
| MIMEtype | A | O | 0 . . . 1 | MIME type of Video | String |
| VideoURI | A | O | 0 . . . 1 | The URI referencing the video | AnyURI |

TABLE 13I

| | | | | | |
|---|---|---|---|---|---|
| Audio | E3 | O | 0 . . . N | Defines how to obtain a audio and MIME type. Contains the following elements: MIMEtype AudioURI | |
| MIMEtype | A | O | 0 . . . 1 | MIME type of Audio | String |
| AudioURI | A | O | 0 . . . 1 | The URI referencing the audio | AnyURI |

TABLE 14

| Name | Type | Category | Cardinality | Description | Data Type |
|---|---|---|---|---|---|
| NTDAERes | E | | | Specifies the Response message for NTDAEReq. Contains the following elements: NTDAEReqId | |
| NTDAEId | E1 | M | 0 . . . N | Identifier of NTDAEReq Contains the following attributes: Response | unsigned Int (32 bits) |
| Response | A | M | 1 | Specifies the result how NTDAEReq is handled in BSM. If Response = 0, Notification Message is generated and delivered to NTD/A. If Response = 1, Notification Message Generation is failed and Retransmission is requested. | Integer (8 bits) |

Figure 12:
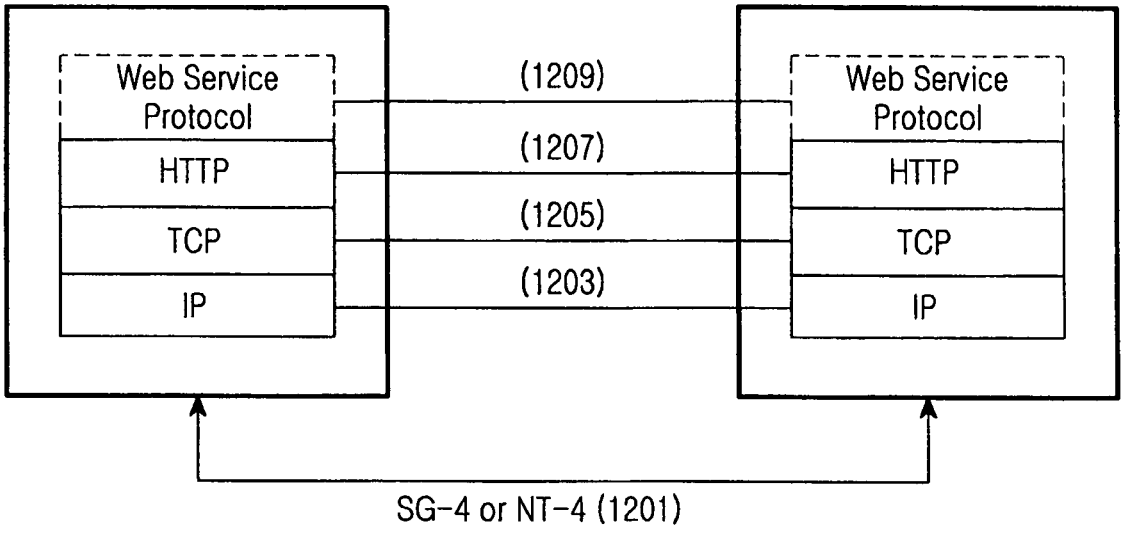
FIG. 12 is a diagram illustrating a protocol stack for delivering a message for requesting provisioning of service guide source or notification event using an SG-4 interface or an NT-4 interface according to another exemplary embodiment of the present invention.

FIG. 12 is a diagram illustrating a protocol stack for delivering a message for requesting provisioning of service guide source or notification event using an SG-4 interface or an NT-4 interface according to another embodiment of the present invention.

For the message delivery over an SG-4 or NT-4 interface 1201, a message can be directly delivered to HTTP as shown in FIG. 6 or 8. In addition, as shown in FIG. 12, the corresponding request message can be transmitted using Web Service Protocol for XML data transmission, like Simple Object Access Protocol (SOAP), Extensible Markup Language-Remote Procedure Call (XML-RPC), and Blocks Extensible Exchange Protocol (BEEP). Reference numerals 1203 to 1209 in FIG. 12 show a hierarchical structure including IP, TCP, HTTP and Web Service Protocol.

Figure 13:
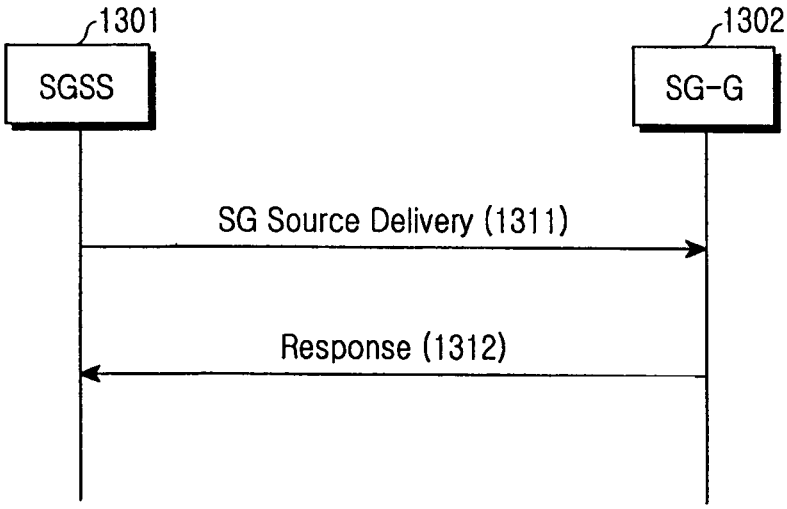
FIG. 13 is a signaling diagram illustrating a process of transmitting a service guide source necessary for generation of a service guide, over an SG-4 interface, according to an exemplary embodiment of the present invention.

FIG. 13 is a signaling diagram illustrating a process of transmitting a service guide source necessary for generation of a service guide, over an SG-4 interface, according to an embodiment of the present invention.

Referring to FIG. 13, in step 1311, an SGSS 1301 sends a request message for delivery of a service guide source, defined in Table 15, to an SG-G 1302. In step 1312, upon receipt of the service guide source through the request message, the SG-G 1302 sends a response message, shown in Table 16 below, including the processing result on the service guide source to the SGSS 1301.

TABLE 15

| Name | Type | Category | Cardinality | Description | Data Type |
|---|---|---|---|---|---|
| SGSDelivery | | | | Specifies the delivery message of Service Guide Source which is used for generating Service Guide in SG-G. Contains the Following attributes: Id EntityAddress Contains the following elements: SGData | |
| SGSDid | A | M | 1 | Identifier of SGSDelivery, unique in Network Entity which generated this message | unsigned Int (32 bits) |
| EntityAddress | A | M | 1 | Network Entity Address which generate this message and receive the response. | anyURI |
| SGData | E1 | O | 0 . . . 1 | Contains information from the Content Creation to be included into the Service Guide. It is RECOMMENDED that the information is delivered in the form of BCAST Service Guide fragments. Other formats MAY be used. If BCAST Service Guide fragments are used, network-mandatory elements or attributes which are not relevant SHALL be delivered as empty field, network-optional elements or attributes which are not relevant SHALL NOT be instantiated. Contains attribute: namespace | |
| namespace | A | O | 0 . . . 1 | Set to the name of the BCAST Service Guide XML namespace to signal that the content of SGData is BCAST SG compliant. | anyURI |

TABLE 16

| Name | Type | Category | Cardinality | Description | Data Type |
|---|---|---|---|---|---|
| SGSDRes | | | | Specifies the Response message for SGSDelivery Contains the following elements: SGSDid | |

TABLE 16-continued

| Name | Type | Category | Cardinality | Description | Data Type |
|---|---|---|---|---|---|
| SGSDid | E1 | M | 1 . . . N | Identifier of SGSDelivery Message<br>Contains the following attributes:<br>StatusCode | unsigned Int(32 bit) |
| StatusCode | A | M | 1 | Indicates the overall outcome how SGSDelivery is processed, according to the global status code . . . | unsigned Byte |

Figure 14:
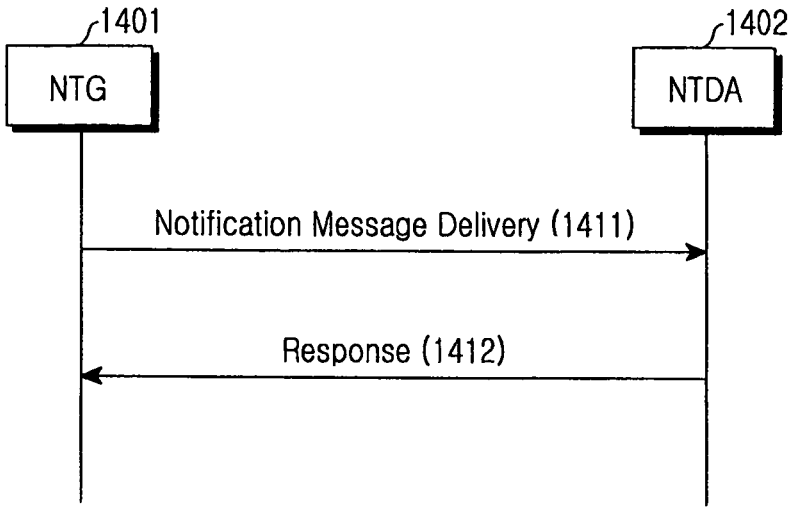
FIG. 14 is a signaling diagram illustrating a process of transmitting a notification message over an NT-4 interface according to another exemplary embodiment of the present invention.

FIG. 14 is a signaling diagram illustrating a process of transmitting a notification message over an NT-4 interface according to another embodiment of the present invention.

In step 1411, an NTG 1401 delivers a notification message defined in Table 17A and Table 17B to an NTDA 1402. The corresponding notification message delivered to the NTDA 1402 in step 1411 is delivered to a corresponding TargetAddress over a broadcast channel or an interaction channel via the NTDA 1402. After sending the notification message to the TargetAddress, the NTDA 1402 sends in step 1412 the processing result on the notification event to the NTG 1401 using a response message defined in Table 18.

TABLE 17A

| Name | Type | Category | Cardinality | Description | Data Type |
|---|---|---|---|---|---|
| NTDReq | E | | | Specifies the Request message of Notification Message Delivery from NTG to NTDA.<br>Contains the following attributes:<br>NTDReqId<br>BSMAddress<br>DeliveryPriority<br>Contains the following elements:<br>TargetAddress<br>NotificationMessage | |
| NTDReqId | A | M | 1 | Identifier of NTDReq | unsignedInt (32 bits) |
| EntityAddress | A | M | 1 | Network Entity Address to receive the response of this request. | anyURI |
| Delivery Priority | A | O | 0 . . . 1 | Defines the delivery priority of this notification message. NTG can request NTDA to deliver this notification message as high priority. If priority = TRUE, it means high priority. If priority = FALSE, it means general message. | Boolean |
| TargetAddress | E1 | O | 0 . . . N | Specifies TargetAddress to deliver notification message.<br>For service-specific notification, AccessID or IPAddress under NotificationReception in AccessFragment can be possible value.<br>If Notification message should be delivered over interaction channel, the value can be e-mail address, IMSI, and so on.<br>If not given, Notification message SHALL be delivered to all users using SGDD.<br>Contains the following attribute | String |

TABLE 17B

| | | | | | |
|---|---|---|---|---|---|
| Delivery Channel | A | M | 1 | Specifies the delivery channel<br>If TRUE, Notification Message SHALL be delivered over Broadcast Channel.<br>If FALSE, Notification Message SHALL be delivered over Interaction Channel. | Boolean |

TABLE 17B-continued

| | | | | | |
|---|---|---|---|---|---|
| Address Type | A | M | 1 | Specifies the type of TargetAddress<br>Value<br>0 - IPAddress<br>2 - anyURI<br>3 - IMSI<br>4–200: For Future Use<br>201–255: For Proprietary Use | unsigned Byte |
| Notification Message | E1 | M | 1 | Specifies the Notification Message, containing information to be included into the notification message. It is RECOMMENDED that the information is delivered in the form of BCAST notification message format. Other formats MAY be used.<br>If BCAST notification message format is used, network-mandatory elements or attributes which are not relevant SHALL be delivered as empty field, network-optional elements or attributes which are not relevant SHALL NOT be instantiated.<br>Contains attribute:<br>Namespace | |
| Namespace | A | O | 0 . . . 1 | Set to the name of the BCAST notification XML namespace to signal that the content of NotificationEvent is compliant with BCAST notification message format. | anyURI |

TABLE 18

| Name | Type | Category | Cardinality | Description | Data Type |
|---|---|---|---|---|---|
| NTDRes | E | | | Specifies the Response message for NTDReq.<br>Contains the following elements:<br>NTDReqId | |
| NTDReqId | E1 | M | 1 . . . N | Identifier of NTDReq<br>Contains the following attributes:<br>StatusCode | unsigned Int (32 bits) |
| StatusCode | A | M | 1 | Indicates the overall outcome how NTDReq is processed, according to the global status code. | unsigned Byte |

Table 19A through Table 19E below show exemplary code values indicating the processing results on the notification event, included in the response message defined in Table 18. If the requirement of the notification message has been well processed, a code value of the response message is set to '000', and the NTG can recognize that the requirement was processed, by checking the corresponding code value.

Table 19A through Table 19B below show Global Status Codes used as the code values, and they are stored in the NTG and the NTDA for future use. Additional codes can be defined according to purpose of the service provider. It is also possible to store the code values in the terminal for future use. These codes can be used for notifying the result through the code value of StatusCode when there is a need to send not only the novel response message but also the processing results of the mobile broadcast system or the mobile terminal. In addition, the response field in Table 14 can also be used in the same usage as the code values.

TABLE 19A

| Code | Status |
|---|---|
| 000 | Success<br>The request was processed successfully. |
| 001 | Device Authentication Failed<br>This code indicates that the BSM was unable to authenticate the device, which may be due to the fact that the user or the device is not registered with the BSM.<br>In this case, the user may contact the BSM, and establish a contract, or get the credentials in place that are used for authentication. |
| 002 | User Authentication Failed<br>This code indicates that the BSM was unable to authenticate the user, which may be due to the fact that the user or the device is not registered with the BSM.<br>In this case, the user may contact the BSM, and establish a contract, or get the credentials in place that are used for authentication. |

TABLE 19A-continued

| Code | Status |
|---|---|
| 003 | Purchase Item Unknown<br>This code indicates that the requested service item is unknown. This can happen e.g. if the device has a cached service guide with old information.<br>In this case, the user may re-acquire the service guide. |
| 004 | Device Authorization Failed<br>This code indicates that the device is not authorized to get Long-Term Key Messages from the RI, e.g. because the device certificate was revoked.<br>In this case, the user may contact the BSM operator. |
| 005 | User Authorization Failed<br>This code indicates that the user is not authorized to get Long-Term Key Messages from the RI, e.g., because the device certificate was revoked.<br>In this case, the user may contact the BSM operator. |

TABLE 19B

| | |
|---|---|
| 006 | Device Not Registered<br>This code indicates that the device is not registered with the RI that is used for the transaction.<br>When this code is sent, the response message includes a registration trigger that allows the device to register.<br>In this case, the device may automatically perform the registration, and, if the registration is successful, re-initiate the original transaction. |
| 007 | Server Error<br>This code indicates that there was a server error, such as a problem connecting to a remote back-end system.<br>In such a case, the transaction may succeed if it is re-initiated later. |
| 008 | Mal-formed Message Error<br>This code indicates that there has been a device malfunction, such as a mal-formed XML request.<br>In such a case, the transaction may or may not (e.g. if there is an interoperability problem) succeed if it is re-initiated later. |
| 009 | Charging Error<br>This code indicates that the charging step failed (e.g. agreed credit limit reached, account blocked) and therefore the requested Long-Term Key Message cannot be provided.<br>The user may in such a case contact the BSM operator. |
| 010 | No Subscription<br>This code indicates that there has never been a subscription for this service item, or that the subscription for this item has terminated.<br>The user may in such a case issue a service request for a new subscription. |

TABLE 19C

| | |
|---|---|
| 011 | Operation not Permitted<br>This code indicates that the operation that the device attempted to perform is not permitted under the contract between BSM and user.<br>The user may in this case contact BSM operator and change the contract. |
| 012 | Unsupported version<br>This code indicates that the version number specified in the request message is not supported by the network.<br>In this case, the user may contact the BSM operator. |
| 013 | Illegal Device<br>This code indicates that the device requesting services is not acceptable to the BSM. E.g. Blacklisted.<br>In this case, the user may contact the BSM operator. |
| 014 | Service Area not Allowed<br>This code indicates that the device is not allowed services in the requested area due to subscription limits<br>In this case, the user may contact the BSM operator or subscribe to the applicable service. |
| 015 | Requested Service Unavailable<br>This code indicates that the requested service is unavailable due to transmission problems.<br>In this case, the request may re-initiated at a later time. |

TABLE 19D

| | |
|---|---|
| 016 | Request already Processed<br>This code indicates that an identical request has been previously processed.<br>In this case, the user or the entity may check to see if the request had already been processed (i.e. received an LTK), if not retry the request. |

TABLE 19D-continued

| | |
|---|---|
| 017 | Information Element Non-existent<br>This code indicates that the message includes information elements not recognized because the information element identifier is not defined or it is defined but not implemented by the entity receiving the message.<br>In this case related entities should contact each other. |
| 018 | Unspecified<br>This code indicates that an error has occurred which cannot be identified.<br>In this case related entities should contact each other. |
| 019 | Process Delayed<br>Due to heavy load, request is in the cue, waiting to be processed.<br>In this case the user or entity should wait for the transaction to complete. |
| 020 | Generation Failure<br>This code indicates that the request information (message) could not be generated.<br>In this case the user or entity should retry later. |

TABLE 19E

| | |
|---|---|
| 021 | Information Invalid<br>This code indicates that the information given is invalid and cannot be used by the system.<br>In this case the request should be rechecked and sent again. |
| 022 | Invalid Request<br>This code indicates that the requesting key materials and messages (e.g., LTKM) are not valid and can not be fulfilled.<br>In this case the request should be rechecked and sent again. |
| 023 | Wrong Destination<br>This code indicates that the destination of the message is not the intended one.<br>In this case the request should be rechecked and sent again. |
| 024 | Delivery of Wrong Key Information<br>This code indicates that the delivered key information and messages (e.g., LTKM) are invalid.<br>In this case the request should be rechecked and sent again. |
| 025~127 | Reserved for future use |
| 128~255 | Reserved for proprietary use |

As can be understood from the foregoing description, according to the present invention, the mobile broadcast system can provide a detailed delivery procedure for delivery and response of a service guide source for service guide generation. In addition, the present invention can provide a detailed delivery method for a notification message generated for a notification event from the BSD/A or the BDS and for notification messages generated for all notification events, and can also provide an efficient response method for the request message.

Embodiments of the present invention can be realized in a number of ways, including computer-readable code written on computer-readable recording medium. The computer-readable recording medium can be any type of recording device in which data is stored in a computer-readable manner. Examples of the computer-readable recording medium include, but are not limited to, ROM, RAM, CD-ROM, magnetic tape, floppy disc, optical data storage, and carrier wave (e.g., data transmission through the Internet). The computer-readable recording medium can be distributed over a plurality of computer systems connected to a network so that computer-readable code is written thereto and executed therefrom in a decentralised manner. Further, functional programs, code, and code segments needed for realising embodiments of the present invention can be easily construed by one of ordinary skill in the art.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A method for delivering a notification event for generation of a notification message for information provisioning to a subscriber receiving a broadcast service in a mobile broadcast system including a first apparatus for handling subscriber information management of the broadcast service, generation of the notification message and a second apparatus for handling delivery of the notification message over a broadcast channel or an interaction channel, the method comprising:

sending, by the second apparatus, a notification event message for requesting generation of the notification message to the first apparatus according to at least one notification event;

generating, by the first apparatus, at least one notification message according to the at least one notification event, generating and sending a response message specifying a value indicating a result of the generation of the at least one notification message to the second apparatus, and sending, by the second apparatus, the at least one notification message over the broadcast channel or the interaction channel based on the information on a delivery channel over which the notification message is to be delivered, wherein the notification event message further comprises priority information for the at least one notification event, and wherein the method further comprises:

generating by the first apparatus the notification message according to the priority information; and generating a request message, requesting delivery of the notification message, including information on a delivery channel over which the notification message is to be delivered and information on a target address of the subscriber to which the notification message is be delivered.

2. The method of claim 1, wherein the notification event message includes address information of a network entity receiving the response message.

3. The method of claim 1, further comprising closing a session between the first apparatus and the second apparatus before generating the notification message.

4. The method of claim 1, wherein a plurality of at least one of the first apparatus and the second apparatus exist for each individual service provider.

5. The method of claim 1, wherein the mobile broadcast system includes an Open Mobile Alliance Browser and Content Mobile Broadcast (OMA BCAST) system.

6. The method of claim 5, wherein the first and second apparatuses exchange the notification event message and the response message using a backend interface.

7. The method of claim 6, wherein the notification event message and the response message are exchanged using an HTTP POST protocol.

8. The method of claim 5, wherein the first apparatus includes a Notification Generation Function (NTG) of a BCAST Subscription Management (BSM), and the second apparatus includes a Notification Distribution Adaptation function (NTDA) in a BCAST Service Distribution/Adaptation (BSD/A).

9. A mobile broadcast system for delivering a notification event for generation of a notification message for information provisioning to a subscriber receiving a broadcast service, comprising:

a first apparatus for managing subscriber information of the broadcast service, handling generation of at least one notification message according to at least one notification event, handling generation of a request message, requesting delivery of the notification message, including information on a delivery channel over which the notification message is to be delivered and information on a target address of the subscriber to which the notification message is delivered, and generating a response message to be sent to a second apparatus specifying a value indicating a result of the generation of the at least one notification message; and the second apparatus for handling delivery of the notification message over a broadcast channel or an interaction channel, sending a notification event message for requesting generation of the notification message to the first apparatus according to the at least one notification event, receiving the response message in response thereto, and then handling delivery of the notification message over the broadcast channel or the interaction channel, wherein the notification event message further includes priority information for the at least one notification event, and wherein the first apparatus generates the notification message according to the priority information.

10. The mobile broadcast system of claim 9, wherein the notification event message includes address information of a network entity receiving the response message.

11. The mobile broadcast system of claim 9, wherein the first apparatus closes a session to the second apparatus before generating the notification message.

12. The mobile broadcast system of claim 9, wherein a plurality of at least one of the first apparatus and the second apparatus exist for each individual service provider.

13. The mobile broadcast system of claim 9, wherein the mobile broadcast system includes an Open Mobile Alliance Browser and Content Mobile Broadcast (OMA BCAST) system.

14. The mobile broadcast system of claim 13, wherein the first and second apparatuses exchange the notification event message and the response message using a backend interface.

15. The mobile broadcast system of claim 14, wherein the notification event message and the response message are exchanged using an HTTP POST protocol.

16. The mobile broadcast system of claim 13, wherein the first apparatus includes a Notification Generation Function (NTG) of a BCAST Subscription Management (BSM), and the second apparatus includes a Notification Distribution Adaptation function (NTDA) in a BCAST Service Distribution/Adaptation (BSD/A).

17. A method for delivering a notification message for information provisioning to a subscriber receiving a broadcast service in a mobile broadcast system including a first apparatus for handling subscriber information management of the broadcast service and generation of the notification message and a second apparatus for handling delivery of the notification message over a broadcast channel or an interaction channel, the method comprising:

generating, by the first apparatus, a request message requesting delivery of the notification message, including information on a delivery channel over which the notification message is to be delivered, from either the broadcast channel or the interaction channel and information on a target address of the subscriber to which the notification message is to be delivered;

generating, by the first apparatus, a response message to be sent to the second apparatus, specifying a value indicating a result of the generation of the notification message, and sending the request message to the second apparatus; and after receiving the request message, sending, by the second apparatus, the notification message over the broadcast channel or the interaction channel based on the delivery channel information and the information on the target address; wherein the request message further includes delivery priority information for delivery of the notification message; and wherein the method further comprises generating by the first apparatus the notification message according to the delivery priority information.

18. The method of claim 17, wherein the request message further includes information on a target address of the subscriber, to which the notification message is delivered;

wherein the method further comprises sending by the first apparatus the notification message over the interaction channel based on the information on the target address.

19. The method of claim 18, wherein the request message further includes address type information indicating a type of the target address.

20. The method of claim 17, wherein the mobile broadcast system includes an Open Mobile Alliance Browser and Content Mobile Broadcast (OMA BCAST) system.

21. The method of claim 20, wherein the first and second apparatuses exchange the notification message using a backend interface.

22. The method of claim 21, wherein the notification message is exchanged using an HTTP POST protocol.

23. The method of claim 20, wherein the first apparatus includes a Notification Generation Function (NTG) of a BCAST Subscription Management (BSM), and the second apparatus includes a Notification Distribution Adaptation function (NTDA) in a BCAST Service Distribution/Adaptation (BSD/A).

24. A mobile broadcast system for delivering a notification message for information provisioning to a subscriber receiving a broadcast service, comprising:

a first apparatus for performing subscriber information management of the broadcast service and generation of the notification message, generating a request message requesting delivery of the notification message, including information on a delivery channel over which the notification message is to be delivered, from either the broadcast channel or the interaction channel and information on a target address of the subscriber to which the notification message is to be delivered, generating a response message to be sent to the second apparatus, specifying a value indicating a result of the generation of the notification message, and sending the request message to the second apparatus; and the second apparatus for, after receiving the request message, sending the notification message over the broadcast channel or the interaction channel based on the delivery channel information and the information on the target address; wherein the request message further includes delivery priority information for delivery of the notification message; and wherein the first apparatus generates the notification message according to the delivery priority information.

25. The mobile broadcast system of claim 24, wherein the request message further includes information on a target address of the subscriber, to which the notification message is delivered; and wherein the first apparatus sends the notification message over the interaction channel based on the information on the target address.

26. The mobile broadcast system of claim 24, wherein the request message further includes address type information indicating a type of the target address.

27. The mobile broadcast system of claim 24, wherein the mobile broadcast system includes an Open Mobile Alliance Browser and Content Mobile Broadcast (OMA BCAST) system.

28. The mobile broadcast system of claim 27, wherein the first and second apparatuses exchange the notification message using a backend interface.

29. The mobile broadcast system of claim 28, wherein the notification message is exchanged using an HTTP POST protocol.

30. The mobile broadcast system of claim 27, wherein the first apparatus includes a Notification Generation Function (NTG) of a BCAST Subscription Management (BSM), and the second apparatus includes a Notification Distribution Adaptation function (NTDA) in a BCAST Service Distribution/Adaptation (BSD/A).

* * * * *